US009355517B2

(12) United States Patent
Wortmann et al.

(10) Patent No.: US 9,355,517 B2
(45) Date of Patent: May 31, 2016

(54) GAMING MACHINE WITH PERSISTENT WILD FEATURE

(71) Applicant: Pridefield Limited, Douglas (IM)

(72) Inventors: Jonathan Bruce Wortmann, Cowies Hill (ZA); Richard Vermaak, Durban (ZA); Terence Igesund, Prestondale (ZA)

(73) Assignee: Pridefield Limited, Douglas (IM)

( * ) Notice: Subject to any disclaimer, the term of this patent is extended or adjusted under 35 U.S.C. 154(b) by 0 days.

(21) Appl. No.: 14/629,448

(22) Filed: Feb. 23, 2015

(65) Prior Publication Data

US 2015/0248810 A1 Sep. 3, 2015

(30) Foreign Application Priority Data

Mar. 3, 2014 (GB) ..... 1403706.3

(51) Int. Cl.
*G07F 17/34* (2006.01)
*G07F 17/32* (2006.01)

(52) U.S. Cl.
CPC ..... *G07F 17/3213* (2013.01); *G07F 17/32* (2013.01); *G07F 17/34* (2013.01)

(58) Field of Classification Search
USPC ..... 463/20, 22
See application file for complete search history.

(56) References Cited

U.S. PATENT DOCUMENTS 7,195,559 B2 3/2007 Gilmore et al.
8,602,867 B2 12/2013 Owen et al.
8,734,222 B2 5/2014 Owen et al.
8,827,796 B2 9/2014 Vermaak et al.
2005/0075158 A1 4/2005 Walker et al.
2008/0188279 A1 8/2008 Seelig et al.
2008/0318659 A1 12/2008 Hosokawa
2013/0017881 A1 1/2013 Watkins
2013/0184046 A1 7/2013 Vermaak et al.

(Continued)

FOREIGN PATENT DOCUMENTS

WO WO 2010/043256 A1 4/2010

OTHER PUBLICATIONS

U.S. Appl. No. 14/629,458, filed Feb. 23, 2015; inventors: Wortmann, Jonathan Bruce; Vermaak, Richard; and Igesund, Terence.

(Continued)

*Primary Examiner* — Pierre E Elisca
(74) *Attorney, Agent, or Firm* — McDonnell Boehnen Hulbert & BergHoff LLP

(57) ABSTRACT

Machines and methods are described for displaying a particular symbol at a corresponding symbol position for multiple consecutive outcome events, such as outcome events including a wager game played on a stand-alone machine located within a casino or a machine within a client-server architecture. After displaying the particular symbol for a first outcome event, the particular symbol can be displayed at the same symbol position within a symbol-display-portion for one or more successive outcome events without the particular symbol being selected to be displayed at the same symbol position. Other symbols displayed within the symbol-display-portion for the first and successive outcome events can be determined or selected by a processor using a random selection process. The particular symbol can be a Wild symbol. A data structure can include data for tracking whether the particular symbol is locked down for an outcome event after the first outcome event.

20 Claims, 21 Drawing Sheets

(56) References Cited

U.S. PATENT DOCUMENTS

2013/0252708 A1* 9/2013 Englman ..... G07F 17/32
463/20
2015/0170461 A1* 6/2015 Berman ..... G07F 17/34
463/20
2015/0170462 A1* 6/2015 Berman ..... G07F 17/34
463/20
2015/0206383 A1* 7/2015 Berman ..... G07F 17/34
463/20
2015/0287269 A1* 10/2015 Berman ..... G07F 17/34
463/20

OTHER PUBLICATIONS

European Patent Office, Munich Germany, European Search Report, Application No. EP 15157464, mailed Jul. 10, 2015, 7 pages.

* cited by examiner

385

| Symbol Position | PS | C | PS | C | PS | C | PS | C | PS | C | PS | C |
|---|---|---|---|---|---|---|---|---|---|---|---|---|
| C1, R1 | No | 0 | Yes | 0 | Yes | 1 | Yes | 2 | Yes | 3 | No | 0 |
| C1, R2 | No | 0 | No | 0 | No | 0 | No | 0 | No | 0 | No | 0 |
| C1, R3 | No | 0 | No | 0 | No | 0 | No | 0 | No | 0 | No | 0 |
| C2, R1 | No | 0 | No | 0 | No | 0 | No | 0 | No | 0 | Yes | L |
| C2, R2 | No | 0 | No | 0 | No | 0 | No | 0 | No | 0 | Yes | L |
| C2, R3 | Yes | 0 | Yes | 1 | Yes | 2 | Yes | 3 | Yes | 0 | Yes | L |
| C3, R1 | No | 0 | No | 0 | No | 0 | No | 0 | No | 0 | No | 0 |
| C3, R2 | No | 0 | Yes | 0 | Yes | 1 | Yes | 2 | Yes | 3 | No | 0 |
| C3, R3 | Yes | 0 | Yes | 1 | Yes | 2 | Yes | 3 | No | 0 | No | 0 |
| C4, R1 | No | 0 | No | 0 | No | 0 | No | 0 | No | 0 | No | 0 |
| C4, R2 | No | 0 | No | 0 | No | 0 | No | 0 | No | 0 | No | 0 |
| C4, R3 | No | 0 | No | 0 | No | 0 | No | 0 | No | 0 | No | 0 |
| C5, R1 | No | 0 | No | 0 | No | 0 | Yes | 0 | Yes | 1 | Yes | 2 |
| C5, R2 | Yes | 0 | Yes | 1 | Yes | 2 | Yes | 3 | No | 0 | No | 0 |
| C5, R3 | No | 0 | No | 0 | No | 0 | No | 0 | No | 0 | No | 0 |
| 1502 | 700-A | | 800-A | | 900-A | | 1000-A | | 1100-A | | 1200-A | |

1500

C#, R# = Column Number, Row Number  C = Counter
PS = Predetermined Symbol  L = Locked

FIG. 15

GAMING MACHINE WITH PERSISTENT WILD FEATURE

PRIORITY

This application claims priority under 35 U.S.C. §119 to United Kingdom Patent Application No. 1403706.3 filed Mar. 3, 2014. United Kingdom Patent Application No. 1403706.3 is hereby incorporated by reference in its entirety.

BACKGROUND

This disclosure relates to gaming machines for playing games such as wager games.

Wager games come in a variety of forms including, for example, a mechanical slot machine. A mechanical slot machine may include one or more reels, each of which includes multiple symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined winning combination of symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game. For example, the machine may have five columns and three rows of symbols, for a total of fifteen symbols. Such machines often have multiple pay lines, each being defined by a collection of positions within the matrix. For example, the machine may have three pay lines, each corresponding to one row of the matrix.

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may include a display that displays an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine over the computer network. In this instance, the server machine may perform the spins of the game and may send the resulting symbols to the client machine for display.

The popularity of video slot games has increased due to the incorporation of a "wild" symbol into such video slot games. A wild symbol, which is usually the highest-ranking symbol of the game, offers line payouts just like any other symbol and, additionally, substitutes for any other symbol in the game, thereby assisting in making winning results and providing a player with entertainment and additional opportunities to win games. In traditional slots games, all symbols, including a wild symbol, if any selected for a spin of the reels are replaced for the next spin of the reels.

Overview

In a first aspect, the disclosure provides for a method comprising: determining, by a processor for a first current outcome event, a first set of symbols and a corresponding symbol position for each symbol of the first set of symbols; determining, by the processor for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event; and displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

The following additional features pertain to the first described aspect. The predetermined number of consecutive outcome events is greater than two outcome events and is typically less than a predetermined number of awarded outcome events. As an example, the predetermined number of consecutive outcome events can be two, three, four, five, six or more consecutive outcome events. Intervening outcome events can occur between two consecutive outcome events if the machine(s) performing the outcome events change(s) from a state in which a first of the two consecutive outcome events (e.g., a bonus outcome event) occurs to a different state in which another type of events occur (e.g., base outcome events), and then back to the state in which the second of the two consecutive outcome events is performed. The predetermined number of awarded outcome events is a number of outcome events greater than two. The awarded outcome events can be bonus outcome events awarded in response to a trigger condition occurring during a base outcome event. The particular symbol can be a Wild symbol, such as any Wild symbol described herein or shown in the figures, but the particular symbol is not so limited.

In a second aspect, the disclosure provides for a machine comprising: a computer-readable processor; a display; and a computer-readable medium storing computer-readable program instructions, that when executed by the processor, cause a set of functions to be performed, the set of functions comprising: determining, by the processor for a first current outcome event, a first set of symbols and a corresponding symbol position for each symbol of the first set of symbol; determining, by the processor for the first current outcome event, that a first instance of a particular symbol determined by the processor to be displayed at a first corresponding symbol position within a symbol-display portion of the display for a first prior outcome event has been displayed less than a predetermined number of consecutive outcome events at the first corresponding symbol position following the first prior outcome even; and displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

In a third aspect, the disclosure provides for a non-transitory computer readable medium storing program instructions, that when executed by a computer-readable processor, cause a set of functions to be performed, the set of functions comprising: determining, by the processor for a first current outcome event, a first set of symbols and a corresponding symbol position for each symbol of the first set of symbols; determining, by the processor for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event; and displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols In a fourth aspect, the disclosure provides for a method comprising: determining, by a processor of a server machine for a first current outcome event, a first set of symbols and a corresponding symbol position for each symbol of the first set of symbols; determining, by the processor for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event; and transmitting, over a communication network from the server machine to a client machine, data for displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

In a fifth aspect, the disclosure provides for a server machine comprising: a processor; a communication interface; and a computer-readable medium storing software instructions, that when executed by the processor, perform a set of functions, wherein the set of functions comprises: determining, by the processor for a first current outcome event, a first set of symbols and a corresponding symbol position for each symbol of the first set of symbols; determining, for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event; and transmitting, over a communication network from the server machine to a client machine, data for displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

In a sixth aspect, the disclosure provides for a non-transitory computer-readable medium storing program instructions, that when executed by a computer-readable processor of a server machine cause a set of functions to be performed, the set of functions comprising: determining, by the processor for a first current outcome event, a first set of symbols and a corresponding symbol position for each symbol of the first set of symbols; determining, by the processor for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event; and transmitting, over a communication network from the server machine to a client machine, data for displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

In a seventh aspect, the disclosure provides for a method comprising: receiving, by a client machine from a server device for a first current outcome event, data indicating a first set of symbols and a corresponding symbol position for each symbol of the first set of symbols; receiving, by the client machine from the server machine for the first current outcome event, data indicating that a first instance of a particular symbol determined for displaying at a first corresponding symbol position within a symbol-display portion of a display for a first prior outcome event has been displayed less than a predetermined number of consecutive outcome events at the first corresponding symbol position following the first prior outcome event; and displaying, by a display within the symbol-display-portion of the display for the first current outcome event, the first instance of the particular symbol, received by the client machine to be displayed at the first corresponding symbol position for the first prior outcome event, at the first corresponding symbol position, and the first set of symbols at the corresponding symbol position for each symbol of the first set of symbols, wherein the display is part of the client machine.

In an eighth aspect, the disclosure provides for a client machine comprising: a processor; a communication interface; and a computer-readable medium storing software instructions, that when executed by the processor, perform a set of functions, wherein the set of functions comprises: receiving, by a client machine from a server device for a first current outcome event, data indicating a first set of symbols and a corresponding symbol position for each symbol of the first set of symbols; receiving, by the client machine from the server machine for the first current outcome event, data indicating that a first instance of a particular symbol determined for displaying at a first corresponding symbol position within a symbol-display portion of a display for a first prior outcome event has been displayed less than a predetermined number of consecutive outcome events at the first corresponding symbol position following the first prior outcome event; and displaying, by a display within the symbol-display-portion of the display for the first current outcome event, the first instance of the particular symbol, received by the client machine to be displayed at the first corresponding symbol position for the first prior outcome event, at the first corresponding symbol position, and the first set of symbols at the corresponding symbol position for each symbol of the first set of symbols, wherein the display is part of the client machine.

In a ninth aspect, the disclosure provides for a non-transitory computer-readable medium storing program instructions, that when executed by a computer-readable processor of a client machine cause a set of functions to be performed, the set of functions comprising: receiving, by the client machine from a server device for a first current outcome event, data indicating a first set of symbols and a corresponding symbol position for each symbol of the first set of symbols; receiving, by the client machine from the server machine for the first current outcome event, data indicating that a first instance of a particular symbol determined for displaying at a first corresponding symbol position within a symbol-display portion of a display for a first prior outcome event has been displayed less than a predetermined number of consecutive outcome events at the first corresponding symbol position following the first prior outcome event; and displaying, by a display within the symbol-display-portion of the display for the first current outcome event, the first instance of the particular symbol, received by the client machine to be displayed at the first corresponding symbol position for the first prior outcome event, at the first corresponding symbol position, and the first set of symbols at the corresponding symbol position for each symbol of the first set of symbols, wherein the display is part of the client machine.

The additional features listed above pertaining to the first aspect of the disclosure, are equally applicable to embodiments of the second, third, fourth, fifth, sixth, seventh, eighth, and ninth described aspects of the disclosure.

In embodiments of the disclosure in which a computer software product (e.g., a computer-readable medium or a computer-readable data storage) is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

DESCRIPTION OF THE FIGURES

Some embodiments of the disclosure will now be described by way of example and with reference to the accompanying drawings.

FIG. 15 depicts an example of data stored in a data structure having storage elements in accordance with an embodiment of the disclosure.

DETAILED DESCRIPTION

I. Introduction

Figure 1:
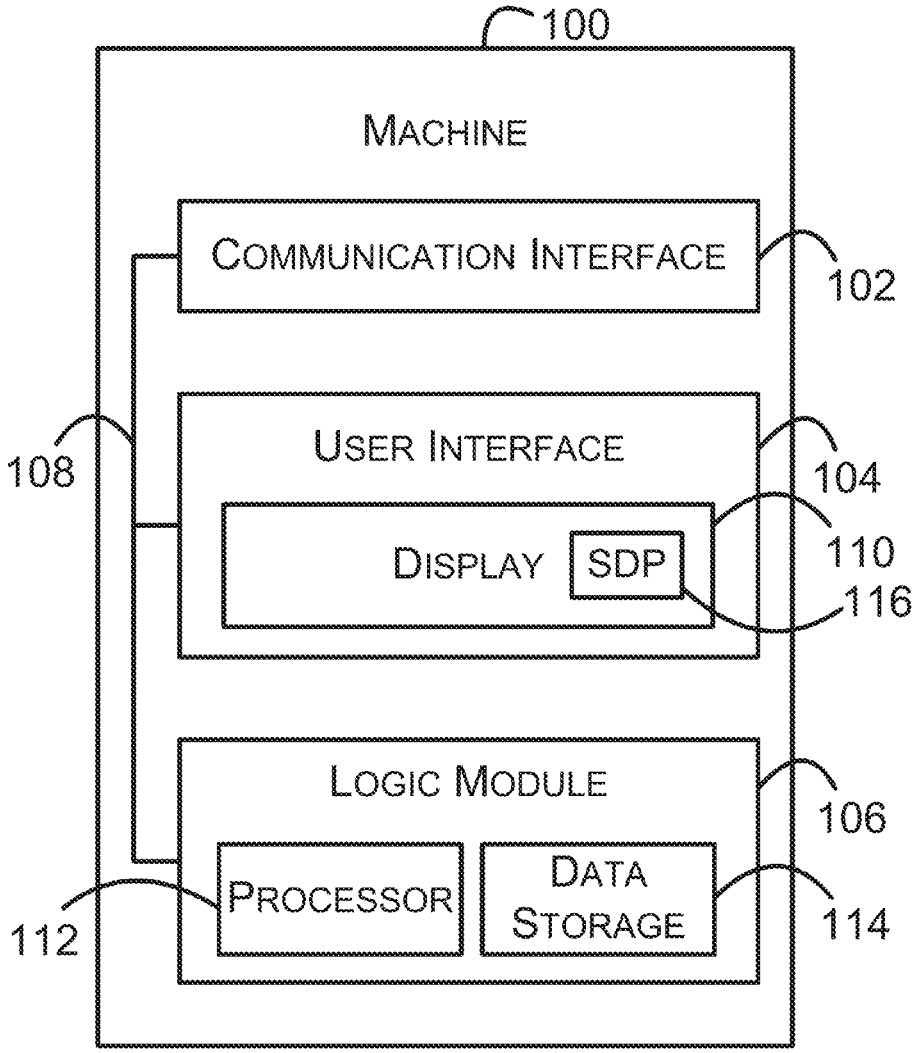
FIG. 1 is a simplified block diagram of an embodiment of a machine in accordance with the disclosure.

This description describes several example embodiments including, but not limited to, example embodiments pertaining to performing aspects of an outcome event using a machine. Performing the outcome event can include playing a game or aspects of playing the game. The machine can display a variety of symbols during performance of an outcome event. A displayed symbol can be a particular symbol that is displayed at a symbol position within a symbol-display-portion of a display during an outcome event and that persists for one or more subsequent plays of the game. The machine can display symbols in motion. Displaying the symbols in motion can include an animation that represents symbols on a reel spinning about an axis.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms. The use of ordinal numbers such as "first," "second," "third" and so on is to distinguish respective elements rather than to denote a particular order of those elements unless the context clearly dictates otherwise.

For purpose of this description, the terms "multiple" and "a plurality of refer" to "two or more" or "more than one."

Disclosed herein are machines and methods for carrying out aspects of outcome events that include displaying symbols, such as games, in particular, wager games. In one aspect, the machines and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favor the casino (sometimes referred to as the "house"). Accordingly, based on the law of averages, casinos often maximize their profits simply by getting more players to play more games. Due to the provided feature, players may be drawn in (e.g., from competing casinos that lack games with such a feature) and they may play the game often.

The described features can include new data communications between a server machine and a client machine within a server-client based configuration. The data communications can include communications to cause a machine to display a particular symbol locked at a corresponding symbol position within a symbol-display-portion for multiple consecutive outcome events. Additionally or alternatively, the data communications can include communications to modify a data structure stored in a computer-readable medium to include data to track whether a symbol position within the symbol-display-portion is to display a locked down instance of the particular symbol. A machine that transmits or receives the data communications can include the computer-readable data structure to store and track data for carrying out one or more of the other described features. Any determination described herein as being made by a machine can be made by a processor of that machine executing program instructions stored in that machine.

The described features include or provide for displaying instances of the particular symbol (e.g. a Wild symbol) locked (or locked down) for multiple consecutive outcome events. A reel within a symbol-display portion can be displayed as spinning beneath the particular symbol. A portion of the reel that stops beneath the particular symbol can be referred to as a non-persistent portion of the particular symbol. A persistent portion of the particular symbol can be displayed fixed at a corresponding symbol position as the reel is spinning and after the reel stops spinning.

II. Example Architecture

FIG. 1 shows a simplified block diagram of an example machine 100 arranged to implement functions in accordance with the example methods described herein. Machine 100 may take any of a variety of forms, including for example a dedicated gaming machine, a stand-alone gaming machine, a personal computer, a personal digital assistant, a mobile phone, a smart phone, a tablet device, or some other computing device.

Machine 100 may include a communication interface 102, a user interface 104, and a logic module 106, all of which may be coupled together by a system bus, network, or other connection mechanism 108. Communication interface 102 may include a wired or wireless network communication interface. For purposes of this description any data described as being sent or transmitted by machine 100 can be data sent by communication interface 102 over a communication network. Also, for purposes of this description any data described as being received by machine 100 can be data sent to communication interface 102 over a communication network.

User interface 104 may facilitate interaction with a user (e.g., a player of a game) if applicable. As such, user interface 104 may take the form of a graphical user interface (GUI) and may include output components such as a speaker and a display 110, and input components such as a keypad or a touch-sensitive screen. The input components can include an input device, such as a push button or handle, to initiate an outcome event (e.g., a base outcome event or a bonus outcome event). Display 110 can include a symbol-display-portion 116. As described in greater detail below, display 110 or symbol-display-portion 116 may be configured to display, among other things, a symbol set in a game or a portion thereof, or a particular symbol that is locked-down at a corresponding symbol position for a predetermined number of outcome events. Display 110 or symbol-display-portion 116 can be configured to display transitions between outcome events. Displaying the transitions can include displaying an animation showing one or more spinning reels or portions of one or more spinning reels within symbol-display-portion 116. Any reference in this description to a display or a symbol-display-portion displaying a symbol refers to the display and the symbol-display-portion displaying the symbol unless context dictates otherwise.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or user interface 104. Any processor discussed in this description or shown in the drawings can be referred to as a computer-readable processor. Any data storage discussed in this description or shown in the drawings can be referred to as computer-readable data storage or a computer-readable medium. Any reference to a computer-readable medium can comprise computer-readable media (e.g., two or more distinct computer-readable mediums).

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the functions described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows™-based operating system (e.g., Windows XP, Windows 7, or Windows 8) provided by the Microsoft™ Corporation of Redmond, Wash.

Machine 100 can be configured to carry out an outcome event described herein without receiving data from or transmitting data to any other machine using communication interface 102

Figure 2:
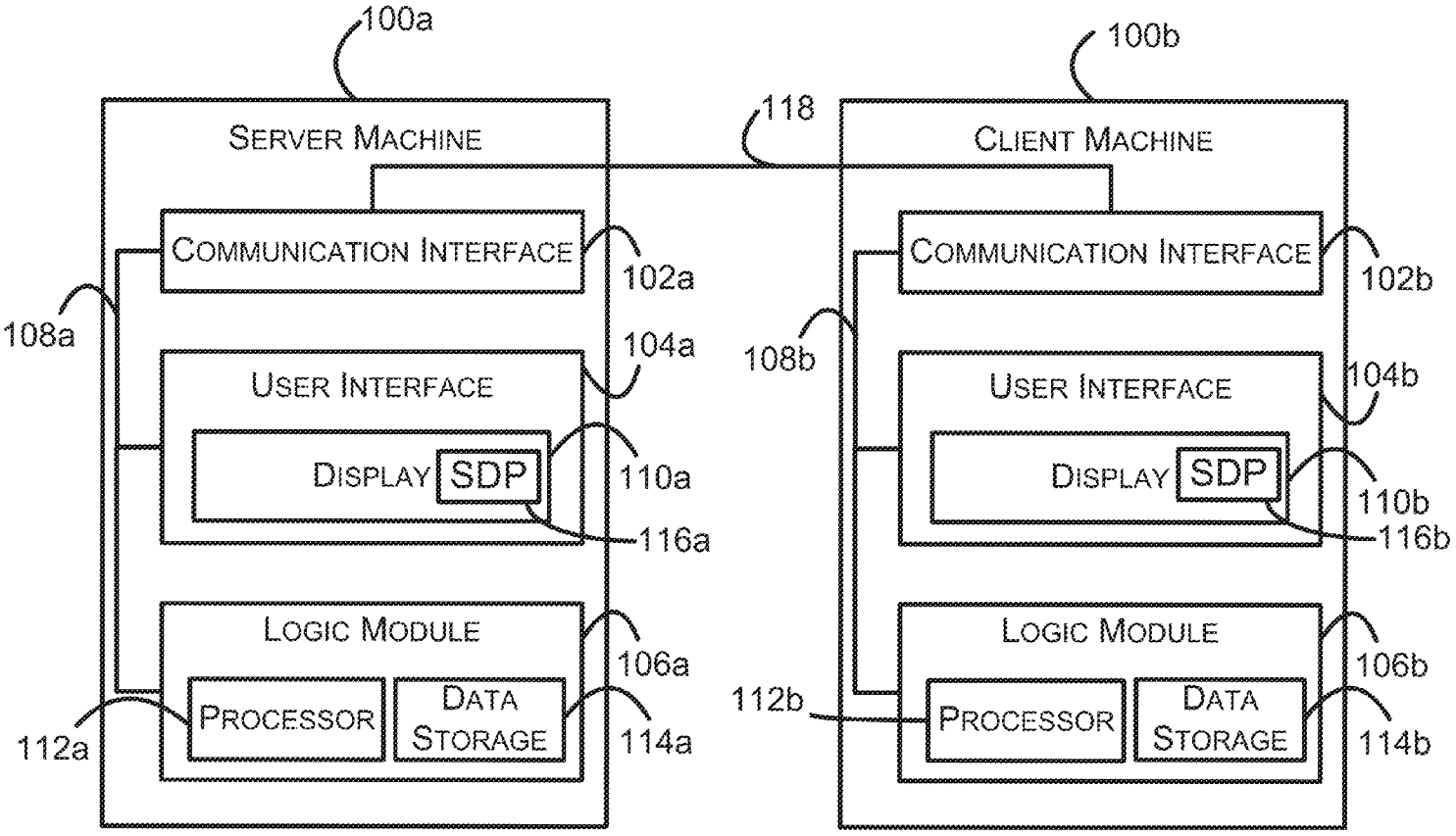
FIG. 2 is a simplified block diagram of an example server machine connected to an example client machine over a computer network, in an embodiment of the disclosure.

FIG. 2 is a simplified block diagram of an example server machine 100*a* connected to an example client machine (sometimes referred to as a workstation) 100*b* over a computer-network 118. A configuration of elements including server machine 100*a* and client machine 100*b* can be referred to as a server-client based configuration.

The components of server machine 100*a* and client machine 100*b* are shown with corresponding "a" and "b" reference numerals (i.e., based on machine 100). For example, server machine 100*a* includes a communication interface 102*a*, a user interface 104*a*, and a logic module 106*a*, all of which may be coupled together by a system bus, network, or other connection mechanism 108*a*. User interface 104*a* can include a display screen 110*a* having a symbol display portion 116*a*. Logic module 106*a* can include a processor 112*a* and data storage 114*a*. As another example, client machine 100*b* includes a communication interface 102*b*, a user interface 104*b*, and a logic module 106*b*, all of which may be coupled together by a system bus, network, or other connection mechanism 108*b*. User interface 104*b* can include a display screen 110*b* having a symbol display portion 116*b*. Logic module 106*b* can include a processor 112*b* and data storage 114*b*. Data storage 114*a* can include program instructions executable by processor 112*a* to carry out the functions described herein as being performed by server machine 100*a*. Similarly, data storage 114*b* can include program instructions executable by processor 112*b* to carry out the functions described herein as being performed by client machine 100*b*.

Server machine 100*a* is configured to communicate client machine 100*b* over the computer-network 118 (via communication interfaces 102*a*, 102*b*). Likewise, client machine 100*b* is configured to communicate with server machine 100*a* over the computer-network 118. For purposes of this description, any data described as being sent or transmitted by server machine 100*a* can be data sent by communication interface 102*a* over communication network 118. Similarly, any data described as being sent or transmitted by client machine 100*b* can be data sent by communication interface 102*b* over communication network 118. Furthermore, for purposes of this description, any data described as being received by server machine 100*a* can be data server machine 100*a* receives from the communication network 118 using communication interface 102*a*. Similarly, any data described as being received by client machine 100*b* can be data client machine 100*b* receives from the communication network 118 using communication interface 102*b*.

The computer-network 118 for the server-client based configuration described above may take a variety of forms. For example, the computer-network 118 may be a local area network (LAN) in a casino, such that client machines 100*b* dispersed throughout the casino may communicate with server machine 100*a* in the casino. In that regard, server machine 100*a* can be configured to serve multiple client machines configured like client machine 100*b*.

In another example, the computer-network 118 may be a wide area network (WAN), such as an Internet network or a network of the World Wide Web. In such a configuration, client machine 100*b* may communicate with server machine 100*a* via a website portal (for a virtual casino) hosted on server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The computer-network 118 may include any of a variety of network topologies and network devices, and may employ traditional network-related technologies, including for example the public switched telephone network, cable networks, cellular wireless networks, WiFi, and WiMAX. Further, the computer-network 118 may include one or more databases (e.g., a player credit account database), to allow for the storing and retrieving of data related to performing an outcome event by a machine.

For purposes of this description, any function listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Figure 5:
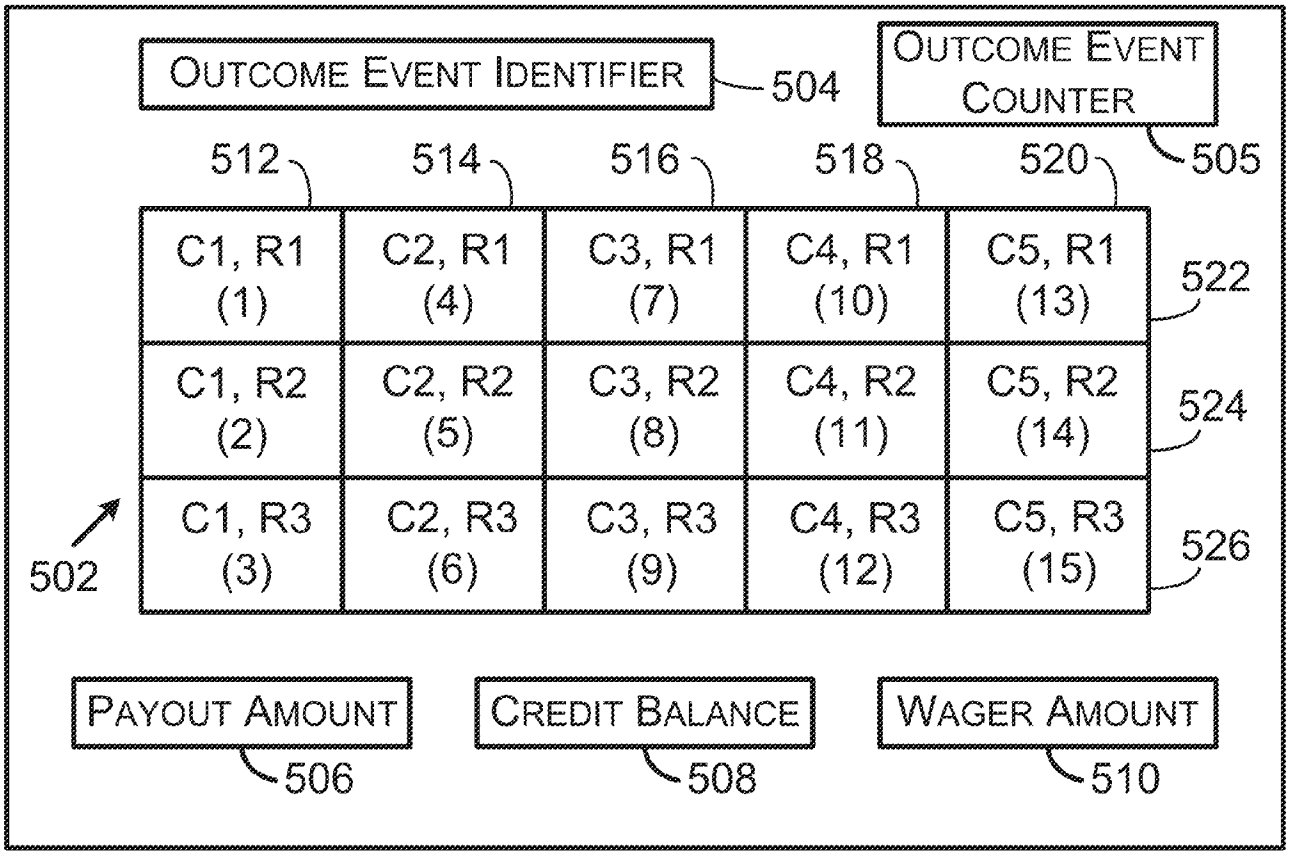
FIG. 5 depicts elements displayable by a display of a machine in accordance with the disclosure.

Next, FIG. 5 depicts a screenshot 500 that machine 100, server machine 100*a*, or client machine 100*b* can visually present (i.e., display) using displays 110, 110*a*, and 110*b*, respectively. For purposes of this description, each element of screenshot 500 can be a displayable element of the display. Screenshot 500 includes a symbol-display-portion 502, an outcome event identifier 504, an outcome event counter 505, a payout amount indicator 506, a credit balance indicator 508, and a wager amount indicator 510. Client machine 100*b* can display symbols for an outcome event using display 110*b*. Server machine 100*a* can display the same symbols for the same outcome event using display 110*a* to allow an administrator or another person to monitor the outcome event being carried out or for some other reason. Display 110*a* can include a symbol display portion 116*a* to display symbols in accordance with the example embodiments. Display 110*b* can include a symbol display portion 116*b* to display symbols in accordance with the example embodiments.

Symbol-display-portion 502 can include multiple symbol-display-segments and multiple symbol positions. As an example, the symbol-display-segments can include vertical symbol-display-segments 512, 514, 516, 518, and 520 (or more simply, vertical SDS 512-520). As another example, the symbol-display-segments can include horizontal symbol-display-segments 522, 524, and 526 (or more simply, horizontal SDS 522-526). Each symbol-display-segment can include multiple symbol positions. The vertical SDS 512-520 are shown in FIG. 5 as having three symbol positions. The horizontal SDS 522-526 are shown in FIG. 5 as having five symbol positions. A person skilled in the art will understand that those symbol-display-segments can be configured with different numbers of symbol positions than shown in FIG. 5.

The vertical SDS 512-520 can be configured as spinnable reels. The processor of a machine or system displaying screenshot 500 can display the spinnable reels spinning and stopped after spinning. For vertical SDS 512-520, the spinnable reels may spin in a vertical direction (e.g., top to bottom or bottom to top, with respect to the symbol-display-portion 502). Spinning a vertical SDS can include displaying an animation showing the vertical SDS spinning. Spinning the vertical SDS can include displaying a first portion of the vertical SDS spinning and a second portion of the vertical SDS at rest.

The horizontal SDS 522-526 can be configured as spinnable reels. The processor of a machine or system displaying screenshot 500 can display the spinnable reels spinning and stopped after spinning. For horizontal SDS 522-526, the spinnable reels may spin in a horizontal direction (e.g., left to right or right to left, with respect to the symbol-display-portion 502). Spinning a horizontal SDS can include displaying an animation showing the horizontal SDS spinning. Spinning the horizontal SDS can include displaying a first portion of the horizontal SDS spinning and a second portion of the horizontal SDS at rest.

The multiple symbol positions in symbol-display-portion 502 are identified by column and row designators, in which C1=column 1, C2=column 2, C3=column 3, C4=column 4, C5=column 5, R1=row 1, R2=row 2, and R3=row 3. The multiple symbol positions in symbol-display-portion 502 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 5, C2 is between C1 and C3, C3 is between C2 and C4, and C4 is between C3 and C5.

For a matrix arrangement with 15 symbol positions as shown in FIG. 5, the numerical identifiers can be whole numbers 1 through 15, inclusive. The processors or machines described herein can be configured to select a symbol position of symbol-display-portion 502 using a random number generator that is configured to generate a number within the range 1 through N, inclusive, where N equals the number of symbol positions in symbol-display-portion 502. For the matrix arrangement, each symbol-display segment can be a distinct column of the multiple columns within the matrix. Alternatively, for the matrix arrangement, each symbol-display segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 504 to display an identifier of the outcome event that can occur during the determined state. For example, the outcome event identifier can identify a base outcome event, a bonus outcome event or another type of outcome event. The bonus outcome event can be a "Free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 510, the determined payout amount to be displayed by the payout amount indicator 506, the determined credit balance to be displayed by the credit balance indicator 508, and the number of awarded remaining outcome events to be displayed by the outcome event counter 505. The processor can provide for distributing the payout amount to an account of an individual or to the individual. Distributing the payout amount can during an outcome event in which the payout amount is won, after the outcome event in which the payout amount is won, but before a next outcome event, or as part of a sum of payout amounts won after multiple outcome events occur, such as a predetermined number of bonus outcome events.

Figure 6:
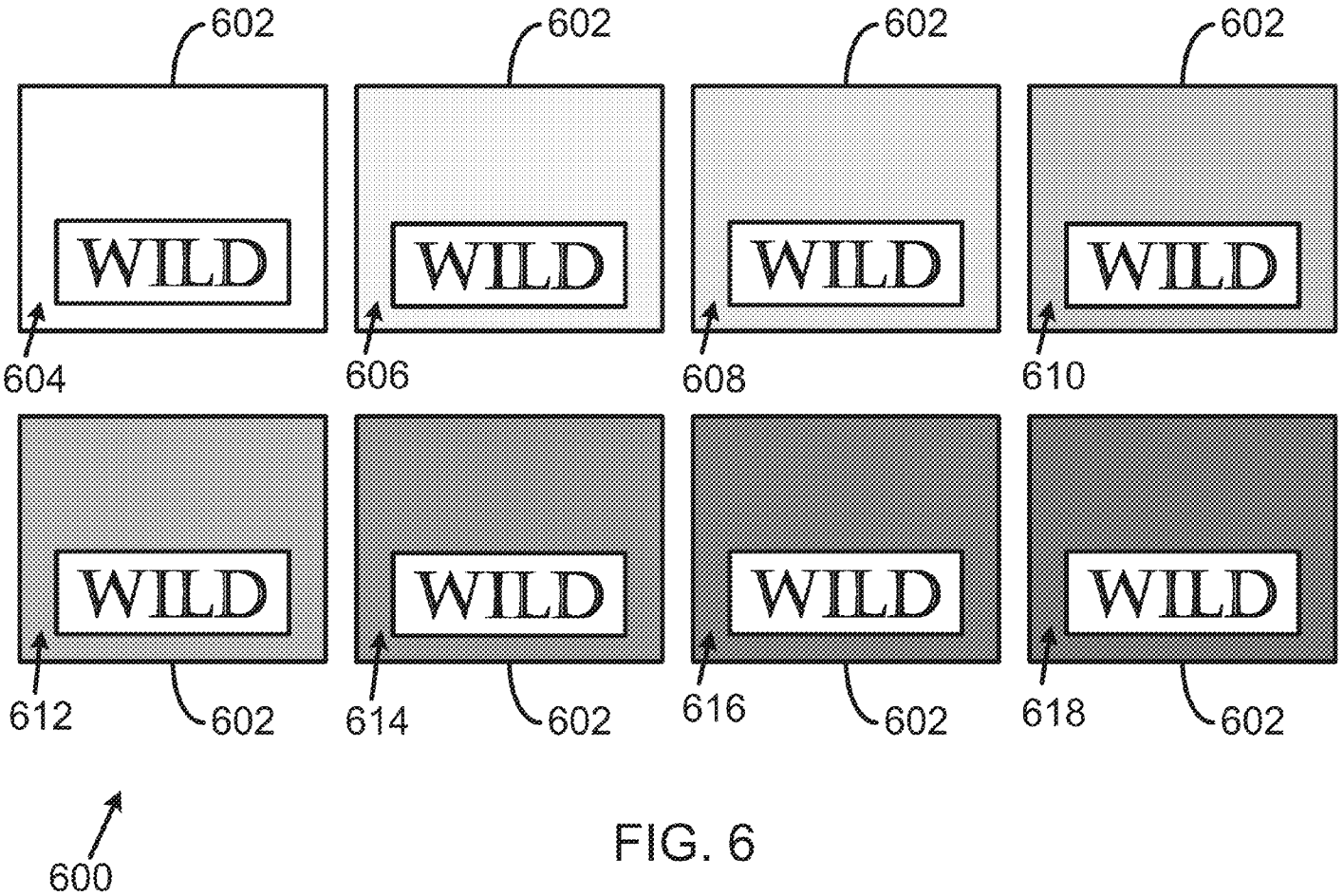
FIG. 6 depicts instances of a particular symbol displayable by a display to provide an indication in accordance with the disclosure.

Next, FIG. 6 depicts an example 600 of instances of a particular symbol 602 displayable by a display, such as displays 110, 110*a*, or 110*b*. The instances of particular symbol 602 can be displayed in a symbol-display-portion 502. A portion of each instance of particular symbol 602 in FIG. 6 has a different level of intensity. Such portions are identified with even whole numbers 604 through 618, respectively.

The instances of the particular symbol 602 can be presented in an order of intensity from a dimmest intensity (e.g., the intensity of portion 618) to a brightest intensity (e.g., the intensity of portion 604) or from the brightest intensity to the dimmest intensity. A processor 112 can provide the instances of the particular symbol 602 images to display 110 in a desired sequence. The processor 112 can provide the instances of the particular symbol 602 at a constant rate (e.g., one symbol instance every M seconds, where M=3 seconds or some other number of seconds). Although, in FIG. 6, the portions of different intensity are shown in various levels of a gray scale, a person skilled in the art will understand that different levels of intensity of other color could be displayed instead. Displaying the particular symbol using multiple intensity levels can include displaying a different number of intensity levels than the eight intensity levels shown in FIG. 6.

III. Example Operation

Figure 3A:
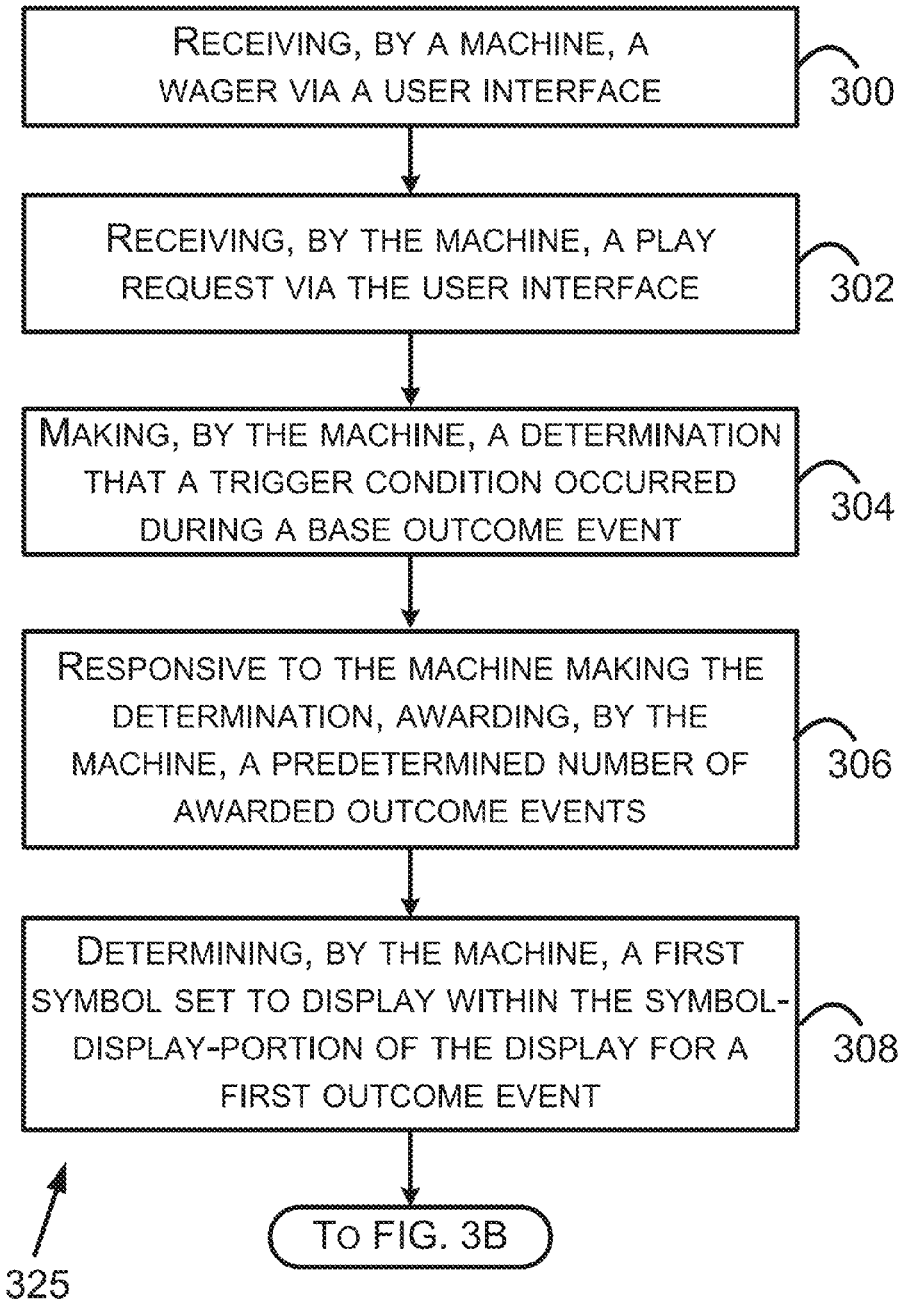
FIG. 3A is a first part of a flow chart showing functions in accordance with a method in an embodiment of the disclosure.
Figure 3B:
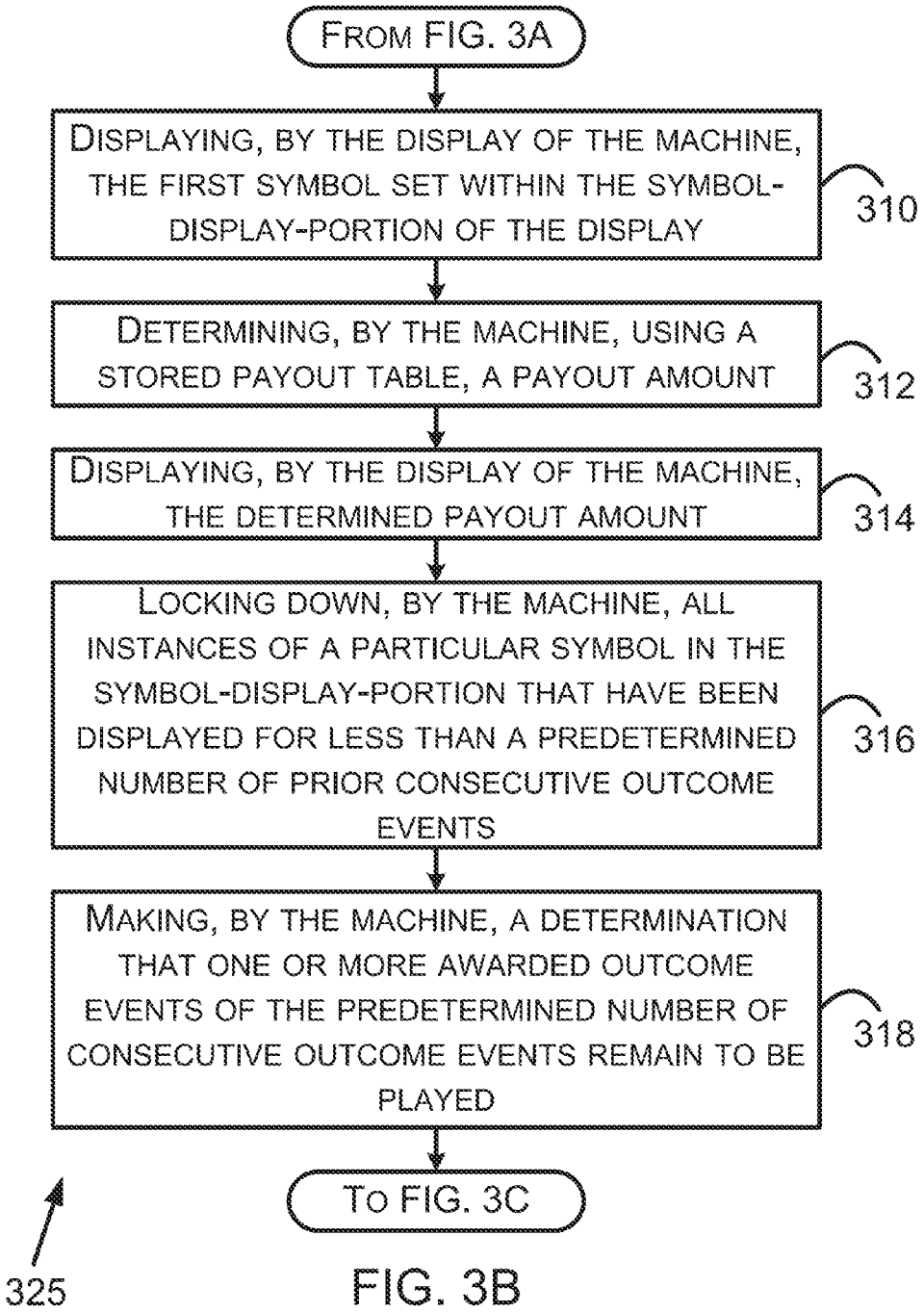
FIG. 3B is a second part of the flow chart of FIG. 3A.
Figure 3C:
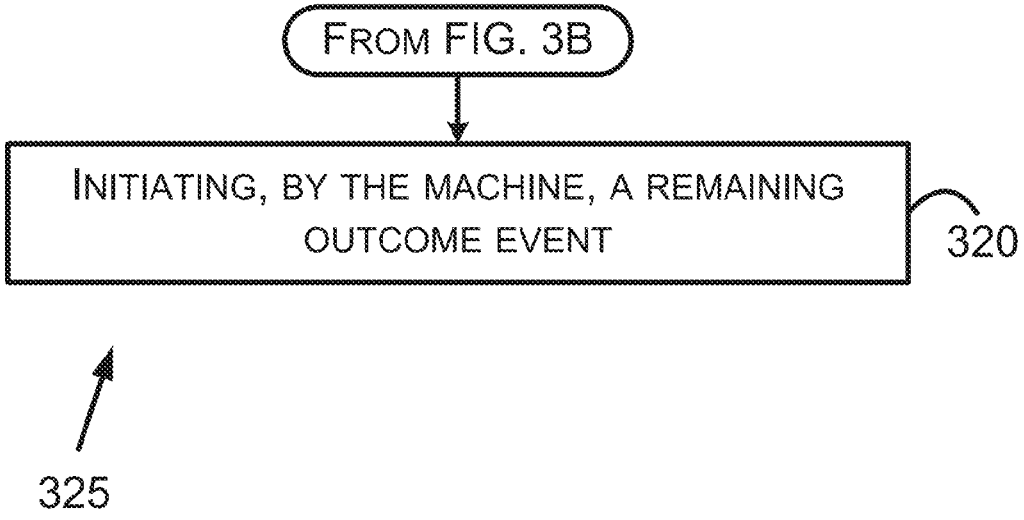
FIG. 3C is a third part of the flow chart of FIG. 3A.

FIG. 3A, FIG. 3B and FIG. 3C (i.e., FIG. 3A-3C) depict a flowchart showing a set of functions (e.g., operations) 325 (or more simply, "the set 325") that can, for example, be carried out using a machine. The functions of the set 325 are shown within blocks labeled with even integers between 300 and 320, inclusive, and can pertain to a method in connection with the machine. The following description of the set 325 includes numeric references, such as 100, shown in a figure other than FIG. 3A-3C. Those numeric references are listed as examples only. The example method can relate to performing outcome events, such as a wager game. Any other function(s) described herein as being performed by machine 100 can be performed prior to, while, or after performing any one or more of the functions of the set 325, unless context clearly dictates otherwise. Those other function(s) can be performed in combination with or separately from any one or more of the functions of the set 325. Any function described below, or elsewhere in this description, with respect to FIG. 3A, FIG. 3B or FIG. 3C, can be performed, at least in part, by a processor, such as processor 112 executing software program instructions.

Block 300 includes receiving, by machine 100, a wager via user interface 104. In one example, this may allow a player to enter a wager (e.g., a wager amount) using a keypad of user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event resulting in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into user interface 104 or by sliding or inserting a payment card, such as a credit or debit card, into user interface 104. Machine 100 can cause display 110 to display wager information such as, but not limited to, a player credit balance on the credit balance indicator 508, possible wager amounts in wager amount indicator 510, and a received wager amount in wager amount indicator 510.

Next, block 302 includes receiving, by machine 100, a play request (e.g., a "spin" request) via user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event if not reduced previously after machine 100 receives the wager or payment.

Next, block 304 includes making, by machine 100, a determination that a trigger condition occurred. The trigger condition can be a randomly occurring event, such an event that randomly occurs during performance of at least some base outcome events. For example, occurrence of the trigger condition can include machine 100 selecting, using a random process, a trigger symbol from a group of symbols, such as in connection with a previous play of the game (e.g., a base outcome event). In another example, occurrence of the trigger condition can include machine 100 selecting a trigger symbol for display in a particular arrangement position (e.g., in a middle row or a middle column). As yet another example, the trigger condition can include machine 100 selecting, using a random number generator, a number in response to machine 100 receiving the play request, where the selected number is a trigger number. As still yet another example, the trigger condition can include machine 100 displaying a particular combination of symbols selected from a global symbol group (which can be referred to as a "global symbol set"). Note that while a few example trigger conditions have been described above, any of a variety of other trigger conditions could be used to suit a desired configuration.

Making the determination that the trigger condition occurred can occur while machine 100 operates in a first machine state (or more simply, the first state). Machine 100 can be configured such that, while machine 100 is operating in the first state, machine 100 allows the player to play base outcome events in which sets of symbols selected from a global symbol group can be selected by processor 112 and displayed by display 110, but a particular symbol displayable for bonus outcome events is not displayable by display 110. Alternatively, the particular symbol can be selected for display during a base outcome event although with or without persisting for more than one outcome event.

Next, block 306 includes, responsive to machine 100 making the determination (i.e., the determination made at block 304), awarding, by machine 100, a predetermined number of awarded outcome events (e.g., plays, spins or turns). The awarded outcome events can be bonus outcome events, such as a game or a wager game. The predetermined number of awarded outcome events can be conditioned upon a combination of symbols displayed by display 110 as a result of or as part of playing a base outcome event. Machine 100 can cause outcome event identifier 504 to identify the bonus outcome event awarded (e.g., a "Free spins" bonus) and to cause the outcome event counter 505 to display the predetermined number. FIG. 7 to FIG. 12 show another example outcome event counter 704 with different numbers of free spins. Viewing FIG. 7 to FIG. 12 in numerical order show the outcome event counter 704 is decremented, such that outcome event counter displays a number indicating how many free spins remain for a user.

As an example, the predetermined number of awarded outcome events can equal five. For purposes of this description, those five awarded outcome events can be numbered, in an order of occurrence, as #1, #2, #3, #4, and #5. Alternatively, the predetermined number of awarded outcome events can equal 4, 6, 8, 9, 10 or some other number. The predetermined number of awarded outcome events can be carried out consecutively.

Furthermore, in response to making the determination at block 304, machine 100 can transition from operating in the first state to operating in a second machine state (or more simply, the second state). As an example, machine 100 can be configured such that, while machine 100 is operating in the second state, machine 100 allows the player to play bonus outcome events in which sets of symbols selected from a global symbol group can be selected by processor 112 and displayed by display 110. As another example, machine 100 can be configured such that, while machine 100 is operating in the second state, a particular symbol is among a global symbol group for selecting to display within symbol display portion 116 and the particular symbol, if selected to display within symbol display portion 116, the displayed particular symbol can be displayed persistently for the outcome event the particular symbol is selected and each outcome thereafter until all of the predetermined number of awarded outcome events have occurred.

Machine 100 can be configured to transition from operating in the second state back to operating in the first state. This transition can occur in response to machine 100 determining any of a variety of trigger conditions, such as, but not limited to, occurrence of all of the awarded predetermined number of consecutive outcome events or a player stopping play of machine 100 while one or more of the awarded predetermined number of consecutive outcome events remain to occur or be played. Machine 100 can be configured to store a number indicating any remaining outcome events of the predetermined number of consecutive outcome events and to allow a player awarded the consecutive outcome events to commence playing any remaining outcome events of the awarded outcome events at a time after the player stops performing (e.g., playing) the outcome events. Upon or after transitioning from the second state to the first state, the particular symbol can be removed from the global symbol group, or can remain in the global symbol group but be non-selectable for base outcome events to be played while machine 100 operates in the first state or be selectable for an instance of an outcome event without persisting for a subsequent outcome event.

Next, block 308 includes determining, by machine 100 (e.g., processor 112), a first symbol set to display within the symbol-display-portion 116 of display 110 for a first outcome event. The first outcome event can be an earliest occurring outcome event of the predetermined number of consecutive outcome events awarded at block 306 or any subsequent outcome event of those awarded outcome events. Determining the first symbol set can include processor 112 selecting the first symbol set (e.g., carrying out a random selection, such as a random selection of the first symbol set from the global symbol group). Additionally or alternatively, determining the first symbol set can include selecting a reel stop position for each reel shown within symbol-display-portion 116. The reel stop position can refer to a position of the reel that permits the symbols on that reel to be displayed for an outcome event.

Determining the first symbol set can include selecting a number of symbols equal to a particular number of symbol positions for displaying symbols selected from the global symbol group. The particular number of symbol positions can equal a number of symbols in symbol display portion 116.

Block 308 can also include determining, by machine 100 (e.g., processor 112) for the first outcome event, a corresponding symbol position for each symbol of the first set of symbols. Determining the corresponding symbol positions can include processor 112 carrying out a random selection of a symbol position for a selected symbol. Alternatively, determining each corresponding symbol position can include processor 112 selecting the symbol position while iterating through each record 412 in the first symbol set table 410 shown in FIG. 4.

If the first outcome event referenced in block 308 is not the earliest outcome event of the predetermined number of awarded outcome events, block 308 can include determining, by machine 100 or processor 112 for the first outcome event, that a particular symbol selected by machine 100 or processor 112 to be displayed at a first corresponding symbol position within the symbol-display-portion 116 of display 110 for a first prior outcome event has been displayed less than a predetermined number of consecutive outcome events at the first corresponding symbol position following the first prior outcome event.

For each instance of the particular symbol displayed in the first prior outcome event that persists to be displayed for the first outcome event, machine 100 or processor 112 does not have to select a symbol from the global symbol group for displaying at the symbol position at which the persistently displayed particular symbol is to be displayed for the first outcome event. In other words, the first set of symbols can include a number of symbols equal to the particular number of symbol positions less a number of instances of the particular symbol that was displayed in a given prior outcome event occurring prior to the first outcome event without any intervening prior outcome event, but not less any instance of the particular symbol that was displayed in the given prior outcome event occurring prior to the first outcome event and is not to be displayed for the first outcome event.

Alternatively, for each of those instances of the particular symbol displayed in the first prior outcome event, machine 100 or processor 112 can select symbols from the global symbol group corresponding to the symbol positions at which the particular symbol is to be displayed for the first outcome event. Machine 100 can be configured to display these selected symbols or to not display these selected symbols. If machine 100 displays these selected symbols, the selected symbols may be displayed beneath another symbol that overlays these selected symbols.

In accordance with the aforementioned alternative example and other examples, the particular symbol may include two parts, namely a persisting part and a non-persisting part. When first appearing on the symbol-display-portion 116, the persisting part and the non-persisting part of the particular symbol can move in unison until arriving at the symbol position at which the particular symbol is to be displayed. Both parts of the particular symbol can be displayed at rest while a payout amount for the outcome event is determined. When the reels within the symbol display portion begin spinning for a next outcome event in which the particular symbol is to persist at a corresponding symbol position, the non-persisting part can spin with the rest of the reel while the persisting part can persist (e.g., remain) at the corresponding symbol position. The reel eventually stops spinning and a symbol selected from the global symbol group for the corresponding symbol position can be displayed with the persisting part. As an example, the persisting part can be represented as a transparent or translucent piece of ice (e.g., an ice cube or ice block) within which the non-persisting part, such as another symbol (e.g., a person or playing card symbol) is positioned.

Turning to FIG. 3B, block 310 includes displaying the first symbol set within the symbol-display-portion 116 of display 110. Displaying the first symbol set can occur as a response to machine 100 determining (e.g., selecting) the first symbol set at block 308. The displaying function of block 310 can include displaying, within the symbol-display-portion 116 of display 110 for the first current outcome event, the particular symbol, selected by processor 112 to be displayed at a first corresponding symbol position for a first prior outcome event, at a first corresponding symbol position, and the first set of symbols at the corresponding symbol position for each selected symbol of the first set of symbols.

Next, block 312 includes determining, by machine 100 (e.g., processor 112) using a stored payout table, a payout amount. The payout table can be stored in data storage 114. The payout table can define multiple symbol combinations and base payout amounts. Table 1 below includes example data that can be stored within the payout table. In Table 1, the multiple symbol combinations include a symbol for each column in a five column matrix arrangement. For a reel type game, the column numbers in Table 1 can refer to reel numbers. A winning symbol combination can be defined for a number of symbols other than five symbols. A Wild symbol located at any given symbol position can take the place of any symbol defined for the given symbol position in any winning symbol combination. As an example, the base payout value can represent a number of credits or an amount of currency.

TABLE 1

| Column 1 | Column 2 | Column 3 | Column 4 | Column 5 | Base Payout |
|---|---|---|---|---|---|
| Ace | King | Queen | Jack | Ten | 100 |
| Ace | Ace | Ace | Ace | King | 75 |
| King | King | Queen | Queen | Queen | 65 |

Processor 112 can execute program instructions to determine whether a payout is earned (e.g., won) as a result of or as part of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set. The corresponding arrangement of symbols can include an instance of the particular symbol that persists from a prior outcome event. Processor 112 can provide for distribution of the payout amount.

The payout amount can be associated with displaying a symbol combination within the symbol-display-portion of a display for an outcome event. For example, the payout amount can be the payout amount associated with a symbol combination located on a pay line selected or being used for the outcome event. As another example, the payout amount can be associated with displaying an instance of the particular symbol, determined by a processor to be displayed at a first corresponding symbol position for a prior outcome event, at the first corresponding position, and a set of symbols at the corresponding symbol positions for each symbol of the set of symbols. A payout amount associated with displaying a symbol combination can, for example, include a payout amount awarded for selecting (during one or more outcome events) the symbol combination or a payout amount associated with data for displaying the symbol combination.

In one example, machine 100 may also provide (e.g., physically dispense) a corresponding payout (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

Next, block 314 includes displaying, by display 110 of machine 100, the determined payout amount. For example, where machine 100 has determined, using the stored payout table, a payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

Next, block 316 includes locking down, by machine 100, all instances of the particular symbol in the symbol-display-portion that have been displayed for less than a predetermined number of prior consecutive outcome events. As an example, processor 112 may execute program instructions to "lock down" any Wild symbol that has been displayed in the symbol-display-area 116 for less than a predetermined number of prior consecutive outcome events. For example, the program instructions may lock down any Wild symbols that have been displayed for less than 3 prior consecutive outcome events while machine is operating in the second state.

Processor 112 can execute program instances to determine other events that cause a particular symbol to be locked down. For example, processor 112 can determine that multiple instances of the particular symbols displayed for an outcome event, such as the first outcome event, form a specific pattern of multiple instances of the particular symbol. In one case, the specific pattern can be formed by multiple instances of the particular symbol selected newly for the first outcome event. In another case, the pattern can be formed by at least one instance of the particular symbol selected newly for the first outcome event and at least one instance of the particular symbol selected for a prior outcome event performed before the first outcome event.

For embodiments in which the symbol-display-portion 116 includes a matrix including multiple columns and multiple rows of symbol positions, the specific pattern can include a pattern in which each symbol of a column of symbol positions displays an instance of the particular symbol, or the specific pattern can include a pattern in which each symbol of a row of symbol positions displays an instance of the particular symbol. Other specific patterns can be defined for locking down symbols.

Locking down the displayed particular symbols in response to processor 112 determining the multiple instances of particular symbols are displayed in the specific pattern for the first outcome event can result in displaying, within the symbol-display-portion 116 of display 110 for each outcome event following the first outcome event until a last awarded outcome event is completed, the multiple instances of the particular symbols at the corresponding symbol positions within the symbol-display-portion 116 of display 110 that form the specific pattern. Depending on how many remaining outcome events exist when the specific pattern of the multiple instances of the particular symbol is detected, a quantity of the each outcome event following the first outcome event can be less than, equal to, or greater than the predetermined number of consecutive outcome events that a particular symbol not included with the specific pattern is locked down.

Next, block 318 includes making, by machine 100 (e.g., processor 112), a determination that one or more of the awarded outcome events of the predetermined number of awarded outcome events remain to be played. In that regard, processor 112 may determine that one or more awarded outcome events have not occurred by referring to data within data storage 114 that is displayed at an outcome event counter 704 shown in FIG. 7. An awarded outcome event has not yet occurred can be referred to as a "remaining outcome event."

Next, block 320 includes initiating, by machine 100, a remaining outcome event. Initiating the remaining outcome event (e.g., a next outcome event or a next consecutive outcome event) can include selecting a symbol set (e.g., a second symbol set) to display within the symbol-display-portion 116 of display 100. The second symbol set can include a symbol selected from the global symbol group for each symbol position within symbol-display-portion. Alternatively, the second symbol set can include a symbol selected from the global symbol group for each symbol position within the symbol-display-portion 116 excluding each symbol position with a locked down instance of the particular symbol. A remaining outcome event can be initiated without a user initiating the remaining outcome event, or the user can initiate the remaining outcome event by user interface 104.

Functions of the set 325 can repeat to carry out each remaining outcome events of the predetermined number of awarded outcome events in response to machine 100 repeating the making of determination of block 318.

The number of symbols in the second symbol set for a remaining outcome event may be the number of symbol positions in the symbol-display portion 116 of display 110 less the number of instances of the particular symbol (e.g. a Wild symbol) locked-down in symbol-display-portion 116 of display 110. Processor 112 can then cause display 110 to simultaneously display, within the symbol-display-portion 116 for the remaining outcome event, the second symbol set of the remaining outcome event and the locked-down symbol(s), if any, from the first outcome event.

The first symbol set selected at block 308 can include selecting the particular symbol and a corresponding symbol position at which the particular symbol is locked down. The set 325 can include determining, by machine 100 (e.g., processor 112), a first determination that the first set of symbols includes an instance of the particular symbol to be displayed at a given corresponding symbol position at which another instance of the particular symbol was, during a prior outcome event occurring prior to the first outcome event, without any intervening prior outcome event, selected for displaying during the first outcome event at the given corresponding symbol position. In response to making that first determination, set 325 can include displaying, within the symbol-display-portion 116 of display 110 for each outcome event following the first outcome event until a last awarded outcome event of the predetermined number of awarded outcome events is completed, the particular symbol at the given corresponding symbol position within the symbol-display-portion 116 of display 100.

The set 325 can include storing, by data storage 114, a data structure 1500 including data that indicates whether each symbol position within the symbol-display-portion 116 of display 100 is to include an instance of the particular symbol for an outcome-event occurring after an outcome event in which the instance of the particular was selected for display, and storing within the data structure 1500 a count for each symbol position to include an instance of the particular symbol for an outcome event occurring after an outcome event in which the instance of the particular symbol was selected for display. The count can indicate how many more times the instance of the particular symbol is to be displayed or how many times the instance of the particular symbol has been displayed since the instance of the particular symbol was selected for display.

FIG. 15 shows an example of the data structure 1500 storable in data storage 114. FIG. 15 includes columns 1502 to show references to the example symbol positions of symbol-display-portion 116, 502. FIG. 15 includes columns 700-A, 800-A, 900-A, 1000-A, 1100-A, and 1200-A to show example data indicating whether the particular symbol is to be displayed at a corresponding symbol position in column 1502 as part of the symbol set 700, 800, 900, 1000, 1100, and 1200, respectively. Columns 700-A, 800-A, 900-A, 1000-A, 1100-A, and 1200-A also include a respective counter corresponding to each symbol position in column 1502 to indicate, for example, how many consecutive outcome events the particular symbol has been displayed at the corresponding symbol or how many remaining outcome events the particular symbol is to be displayed at the corresponding symbol position. The counter for each corresponding can also include an indicator, where appropriate as described above, to indicate the particular symbol is locked-down for each remaining outcome event of the predetermined number of awarded outcome events. In FIG. 15, that indicator is represented by the letter "L."

The Set 325

The global symbol group can include multiple symbols, such as a portrait or graphical image of a person, a Wild, an Ace, a King, a Queen, or a Jack that may be used in connection with the outcome event, such as a wager game. The Ace, King, Queen, and Jack symbols can represent symbols found on a standard deck of playing cards.

Figure 4:
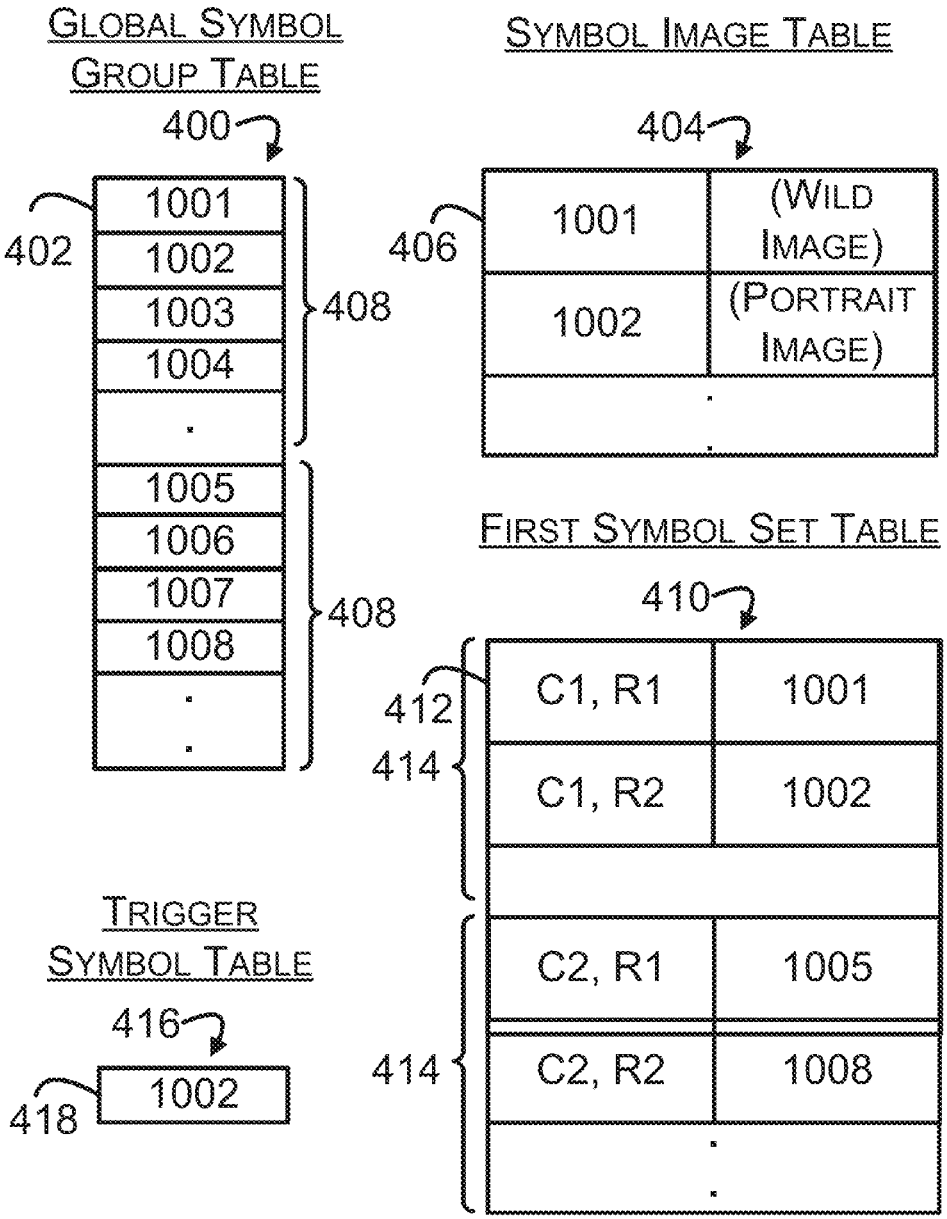
FIG. 4 depicts diagrams of tables used in accordance with machines and methods in embodiments of the disclosure.

In one example, the global symbol group may be represented as a table (or other data structure) stored in data storage 114. FIG. 4 shows an example global symbol group table 400. The global symbol group table 400 includes multiple records 402, each including an identifier (e.g., 1001, 1002, 1003, 1004, etc.) that represents a selectable symbol for displaying at a symbol position within a symbol-display-portion. In one example, the global symbol group, and therefore the global symbol table 400, may be divided into multiple sub-groups 408 as discussed in greater detail below. The global symbol group may be customized with different images as desired.

The global symbol group table 400 may be used in connection with a symbol image table 404. The symbol image table 404 includes multiple records 406 (shown as distinct rows of table 404), each including an identifier that represents a particular symbol, and a corresponding displayable image. As such, the symbol image table 404 may be used to map an identifier in the global symbol group table 400 to a displayable image. The Wild Image mapped to identifier 1001 can appear as a Wild symbol. The Wild symbol, represented by the Wild Image mapped to identifier 1001, can be the particular symbol discussed herein. In that regard, the processor 112 can select the particular symbol to be displayed by selecting the identifier 1001 from among all of the identifiers in global symbol group table 400.

A selected first symbol set may be represented by a first symbol set table 410. The first symbol set may be selected for a first outcome event. The first symbol set table 410 includes multiple records 412 (shown as distinct rows in table 410), each record including an arrangement position of the symbol (or more simply, a "symbol position"), and an identifier that represents the symbol. As such, each symbol in the selected first symbol set may correspond with a respective symbol position in an arrangement (e.g. both a column number and a row number in a column-and-row arrangement). As an example, C1, R1, shown in the first symbol set table 410, represents a symbol position at column 1 (e.g., a left-most column of a plurality of columns in a symbol-display-portion 502 of display 110) and row 1 (e.g., at top row of a plurality of rows in a symbol-display-portion 502 of display 110). The column identifiers in table 410 (e.g., C1 and C2) can refer to columns in a symbol matrix or reels of a plurality of reels that can be spun.

In one example, machine 100 may select the first symbol set by iterating through each record 412 in the first symbol set table 410, and selecting a symbol identifier from among the symbol identifiers in the global symbol group table 400. In one example the symbol identifiers are numbers and machine 100 uses a random number generator to select such numbers, and therefore to randomly select symbols. The first symbol set table 410 can include separate records 414 for each symbol-display-segment (SDS).

In one example, machine 100 may select each subset in the first symbol set from the corresponding sub-group 408 in the global symbol group. This type of selection may be used when the symbol set represents one or more reels in a reel-type wager game. In this instance, each sub-group 408 includes all the symbols of a given reel, and the selected sub-set includes the symbols of the reel that are "in play", namely those included in the selected first symbol set.

The symbol position of the at least one particular symbol in the first symbol set may be unrestricted. For instance, the at least one particular symbol can be located at any symbol position. Alternatively, the symbol position of the at least one particular symbol in the symbol set may be restricted, such as restricting the at least one particular symbol to being located in a particular subset of symbol positions.

As noted above, for each symbol in the selected first symbol set, the example embodiments can include machine 100 randomly determining a corresponding symbol position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

In one respect, data storage device 114 can include one or more other symbol set tables similar to the first symbol set table 410, although not necessarily including or prohibited from including the identifiers corresponding to the symbol positions within the first symbol set table 410. In another respect, data storage device 114 can reuse the first symbol set table 410 to store selected symbol identifiers for a next consecutive outcome event following the first outcome event. Processor 114 can select a respective set of symbols from the global symbol group table 400 for each outcome event carried out using machine 100.

The global symbol group table 400 can be used for selecting symbols to be displayed for bonus outcome events. The global symbol group table 400, a modified version of global symbol group table 400 or a different global symbol group table can be used for base outcome events. The modified version of the global symbol group table 400 or the different global symbol group table can include an identifier for a trigger symbol. Selecting one or more trigger symbols for display in the symbol-display-portion 502, in a predetermined patter or otherwise, during a base game can result in triggering a predetermined number of bonus outcome events. Data storage device 114 can include a trigger symbol table 416 including one or more trigger symbol records 418 to store an identifier of a symbol selected as a trigger symbol. The trigger symbol table 416 can be, but is not required to be, cleared out (e.g., filled with null values) while the bonus outcome events are occurring.

Figure 7:
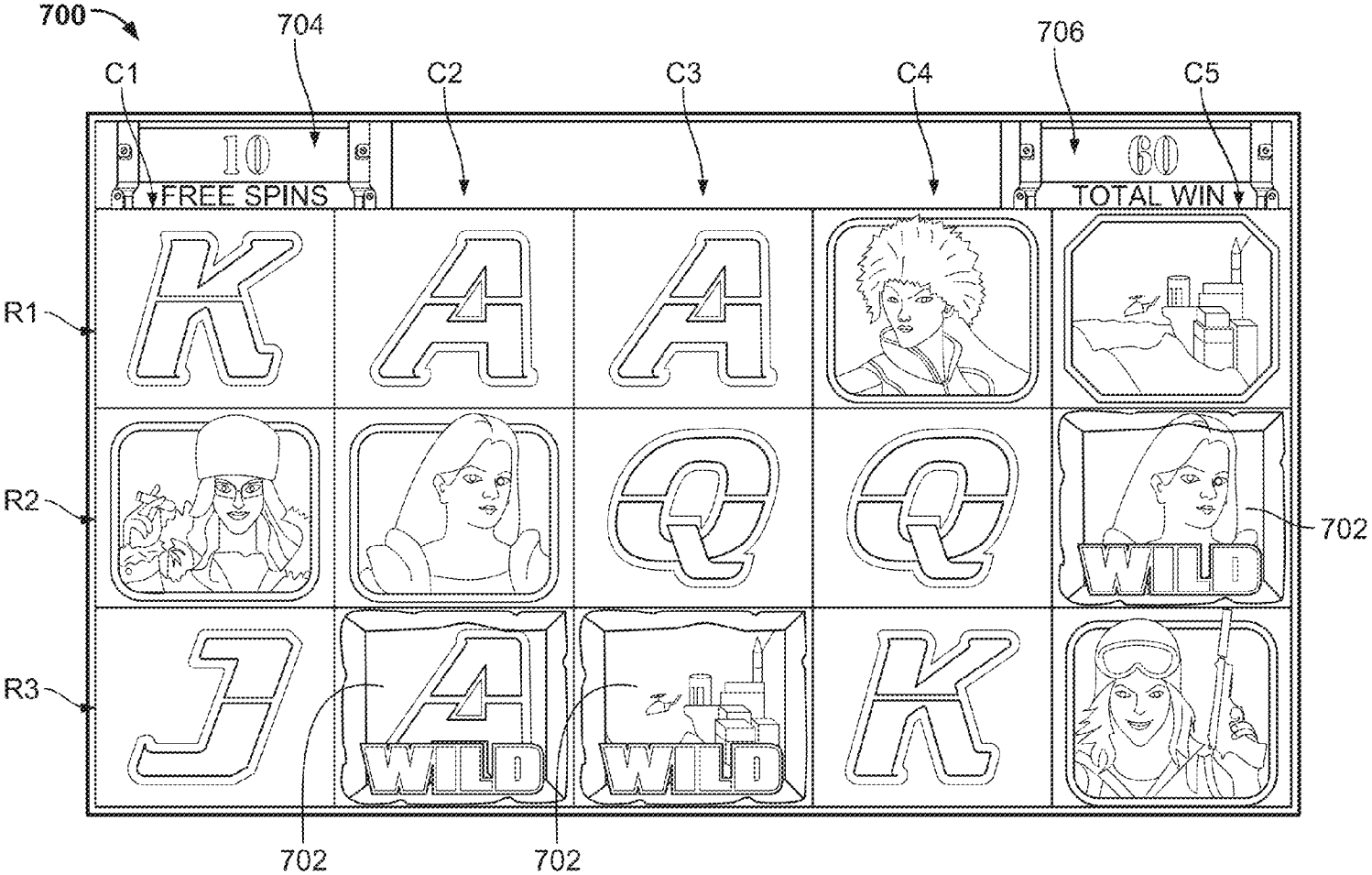
FIG. 7 depicts an example of a selected symbol set displayed by a display in accordance with the embodiments of the disclosure.

Next, FIG. 7 shows an example of a symbol set (or "set of symbols") 700 selected from the global symbol group for display during a bonus outcome event. The symbol set 700 can be displayed in a symbol-display-portion 116, 502. As described above, the bonus outcome event can be initiated pursuant to machine 100 making a determination that one or more of the awarded outcome events have not yet occurred (i.e., remain to occur). The symbol set 700 can be the first symbol set selected for the first outcome event or a symbol set selected for a remaining outcome event. The symbol set 700 includes three instances of a particular symbol (i.e. the Wild symbol) 702 at the symbol position column 2, row 3, the symbol position column 3, row 3; and the symbol position column 5, row 2 in the arrangement that includes columns C1 through C5 and rows R1 through R3. The remaining positions in the symbol-display-portion 116 display other symbols selected from the global symbol group. Where the column and row arrangement is used to simulate reels, machine 100 may display a subset of symbols selected for the symbol set 700 in a corresponding column, such as by superimposing each subset over a virtual reel in a corresponding column.

The Wild symbols 702 shown in FIG. 7 include a persistent part that overlays a non-persistent part (e.g., a non-Wild symbol) selected from the global symbol group. For example, the Wild symbol 702 at C2, R3, overlays an Ace symbol, the Wild symbol 702 at C3, R3, overlays a skyline scene symbol, and the Wild symbol 702 at C5, R2, overlays a first person symbol. The first person symbol is also shown in FIG. 7 at C2, R2, but without the persistent portion (the Wild portion) of the particular symbol displayed at C5, R2. Different people symbols are shown in FIG. 7 at C 4, R1, C1, R2, and C5, R3.

FIG. 7 also shows an outcome event counter 704 that displays a number of free spins remaining to be played, and a payout amount indicator 706 that displays a payout amount earned. An amount showed in payout amount indicator 706 can include an amount earned for a current outcome event or a sum of amounts earned for multiple prior outcome events. Outcome event counter 704 and payout amount indicator 706 are also shown in FIG. 8 through 12 with different values. Outcome event indicator 704 shows the number of remaining outcome events (e.g., free spins) is 10.

Figure 8:
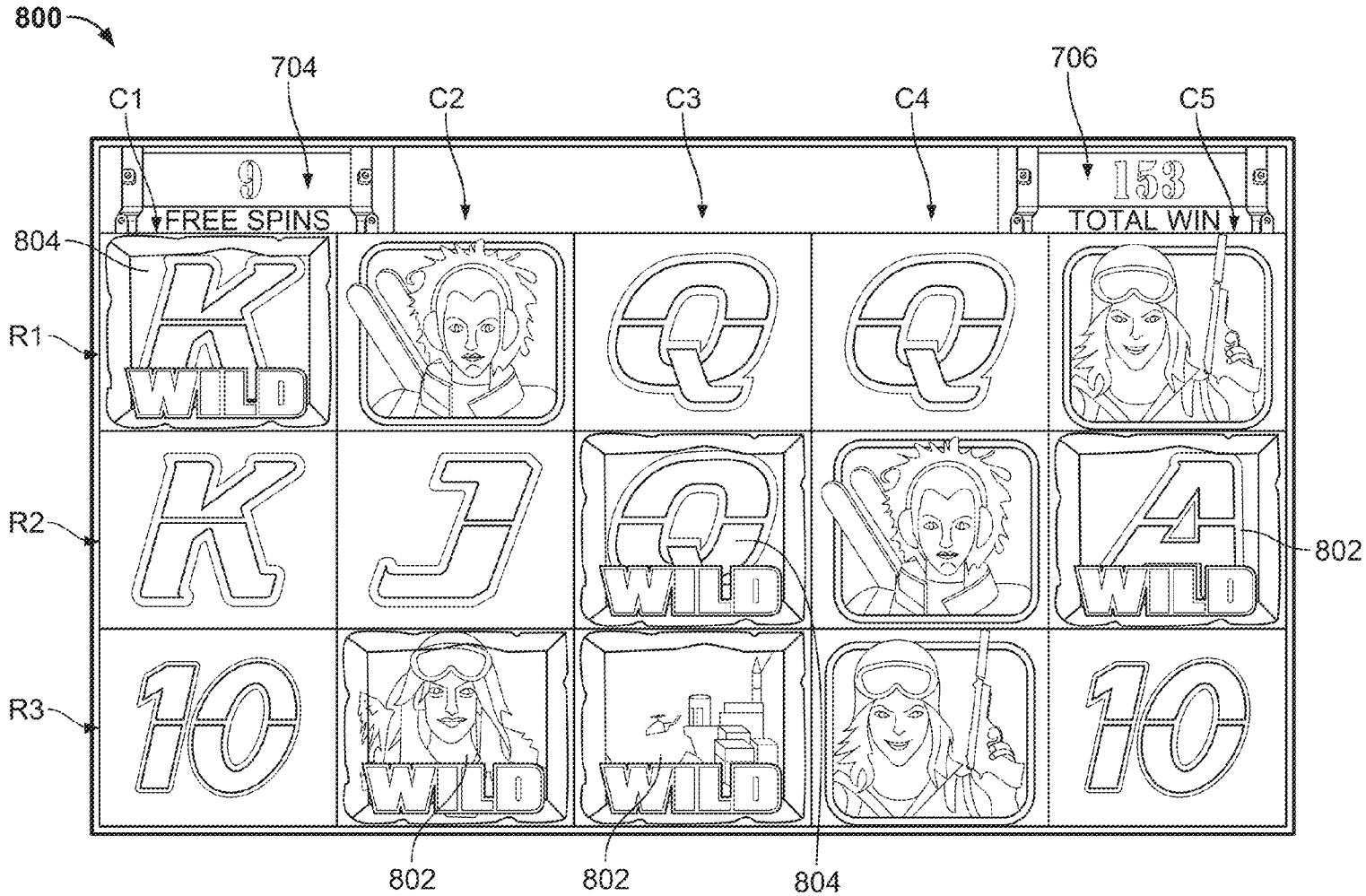
FIG. 8 depicts an example of another selected symbol set displayed by a display in accordance with the embodiments of the disclosure.

Next, FIG. 8 shows an example of another symbol set 800 selected from the global symbol group for display during a remaining (e.g., a next) outcome event occurring after the outcome event represented by FIG. 7. The symbol set 800 can be displayed in a symbol-display-portion 116, 502. As described above, the remaining outcome events discussed with respect to FIG. 8 to FIG. 12 can be initiated pursuant to machine 100 making a determination that one or more of the awarded bonus outcome events have not yet occurred (i.e., remain to occur). The symbol set 800 includes 3 locked-down Wild symbols 802 from a prior outcome event (at symbol positions C2, R3; C3, R3 and C5, R2 within symbol-display-portion 116 of display 110). The symbol set 800 also includes two further Wild symbols at 804 at symbol positions C1, R1 and C3, R2. The wild symbols 804 are selected for the outcome event represented by FIG. 8. Outcome event indicator 704 shows the number of remaining outcome events (e.g., free spins) is 9.

Figure 9:
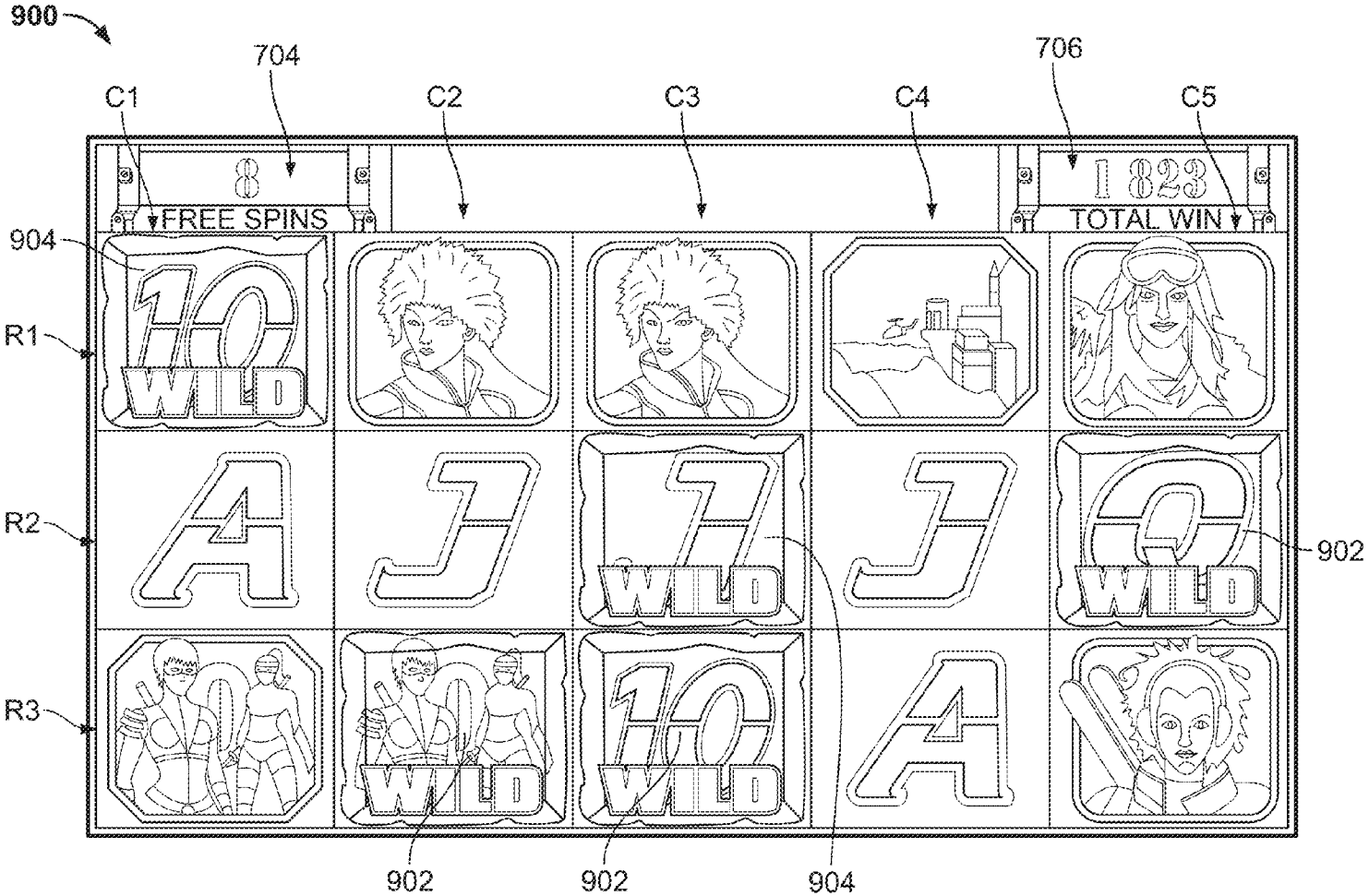
FIG. 9 depicts an example of a further selected symbol set displayed by a display in accordance with the embodiments of the disclosure.

Next, FIG. 9 shows an example of another symbol set 900 selected from the global symbol group for display during a remaining (e.g., a next) outcome event occurring after the outcome event represented by FIG. 8. The symbol set 900 can be displayed in a symbol-display-portion 116, 502. The symbol set 900 still includes the 3 locked-down Wild symbols 902 that first appeared in the outcome event represented by FIG. 7 (at symbol positions C2, R3; C3, R3 and C5, R2 of symbol-display portion 116 of display 100) and the 2 locked-down symbols 904 that first appeared in the outcome event represented by FIG. 8 (at symbol positions C1, R1 and C3, R2 of symbol-display-portion 116 of display 100). The symbol set 900 does not contain any additional Wild symbols that have appeared for the first time in the outcome event represented by FIG. 9. Outcome event indicator 704 shows the number of remaining outcome events (e.g., free spins) is 8.

Figure 10:
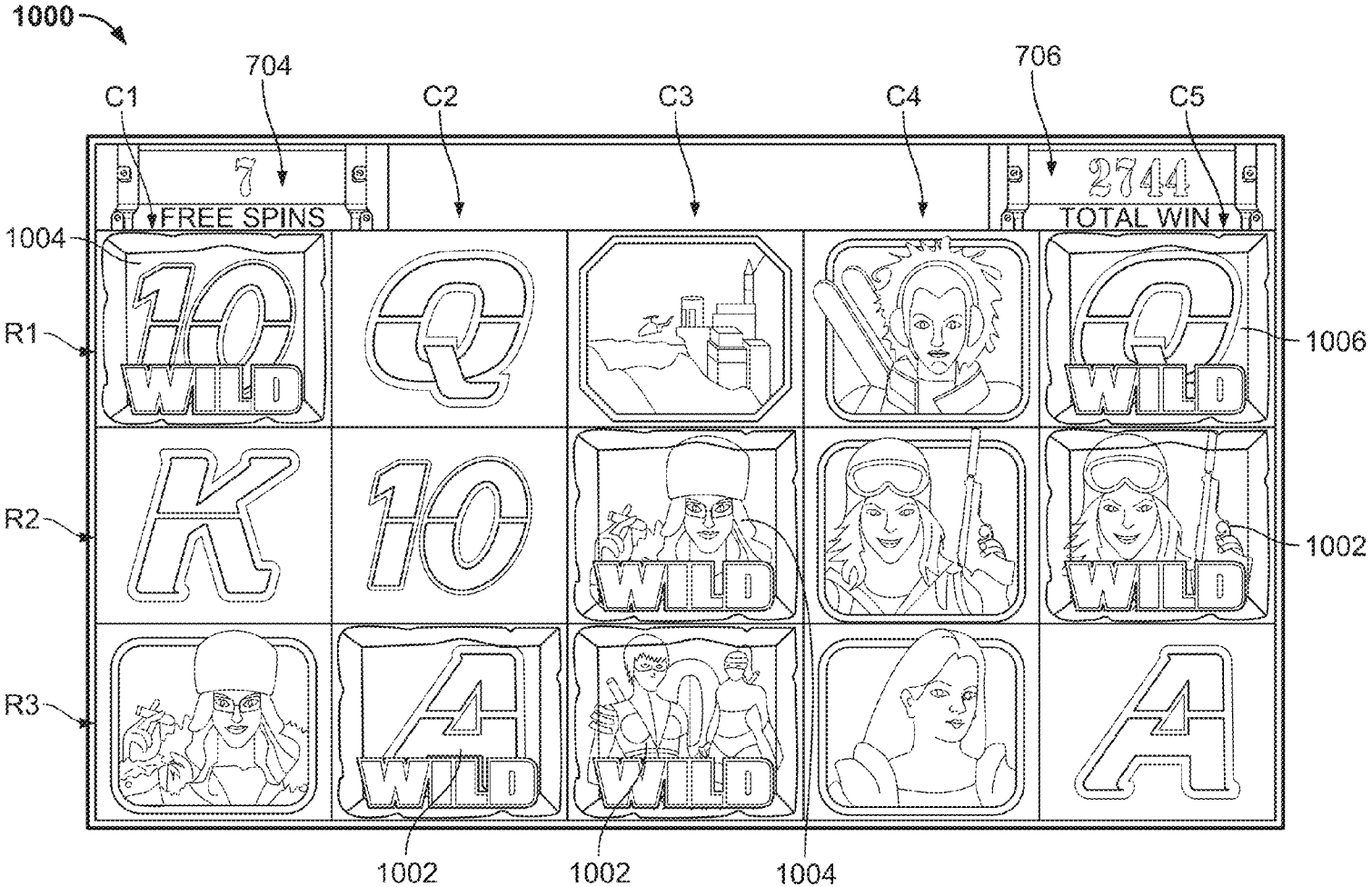
FIG. 10 depicts an example of a still further selected symbol set displayed by a display in accordance with the embodiments of the disclosure.

Next, FIG. 10 shows an example of another symbol set 1000 selected from the global symbol group for display during a remaining (e.g., a next) outcome event occurring after the outcome event represented by FIG. 9. The symbol set 1000 can be displayed in a symbol-display-portion 116, 502. The symbol set 1000 still includes the 3 locked-down Wild symbols 1002 that first appeared in the outcome event represented by FIG. 7 (at symbol positions C2, R3; C3, R3 and C5, R2 of the symbol-display-portion of the display) and the 2 locked-down Wild symbols 1004 that first appeared in the outcome event represented by FIG. 8 (at symbol positions C1, R1 and C3, R3 of the symbol-display-portion of the display). The symbol set 1000 also includes a further Wild symbol 1006 at symbol position C5, R1 selected to appear for the outcome event represented by FIG. 10. Outcome event indicator 704 shows the number of remaining outcome events (e.g., free spins) is 7.

Figure 11:
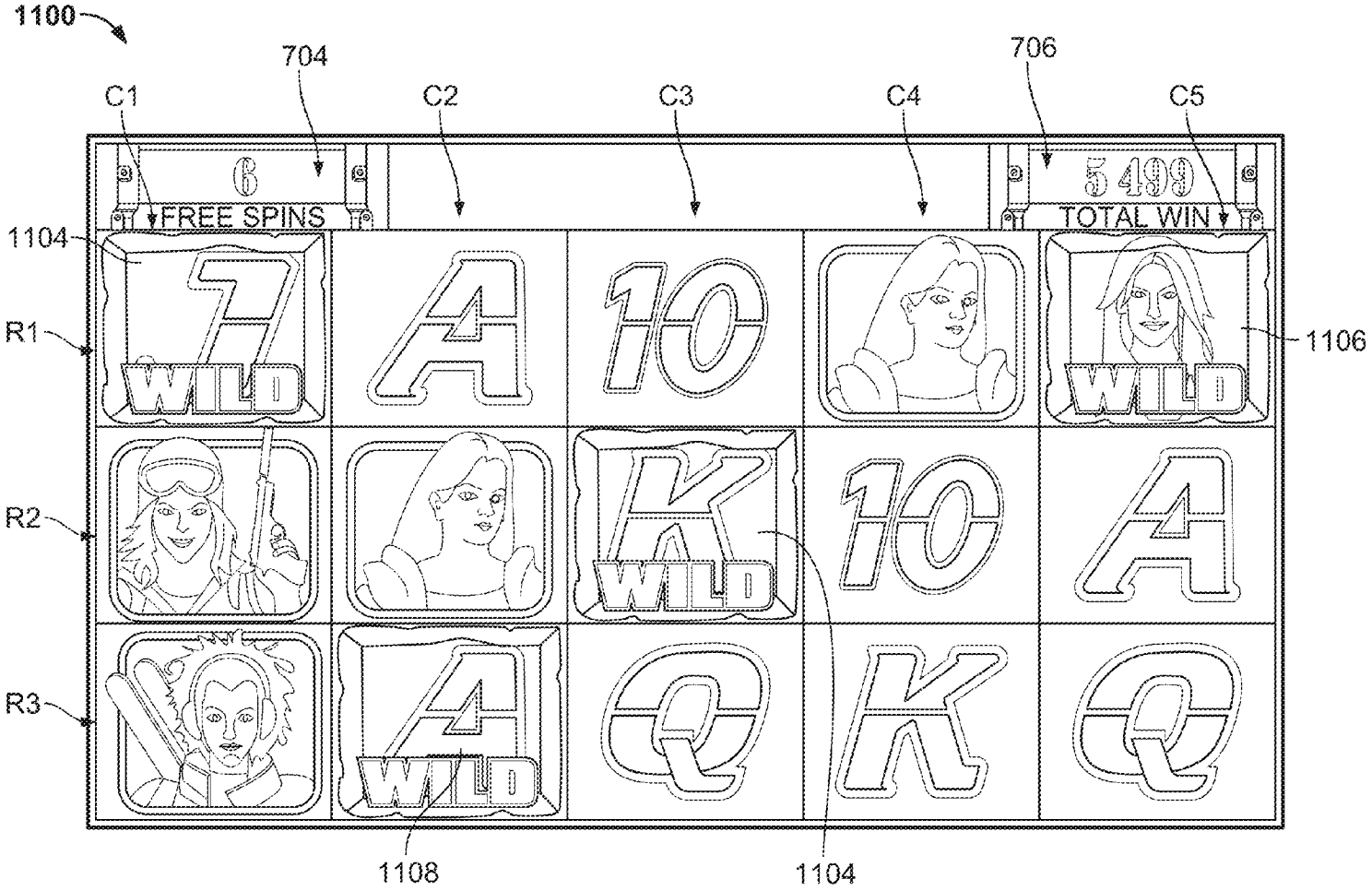
FIG. 11 depicts an example of a yet further selected symbol set displayed by a display in accordance with the embodiments of the disclosure.

Next, FIG. 11 shows an example of another symbol set 1100 selected from the global symbol group for display during a remaining (e.g., a next) outcome event occurring after the outcome event represented by FIG. 10. The symbol set 1100 can be displayed in a symbol-display-portion 116, 502. The 3 Wild symbols that first appeared in the outcome event represented by FIG. 7 and that were locked down for the next 3 outcome events, have been replaced. The two Wild symbols 1104 that first appeared in the outcome event represented by FIG. 8 are still locked-down (at symbol positions C1, R1 and C3, R2). The Wild symbol 1106 that first appeared in the outcome event of FIG. 10 is still locked-down (at symbol position C5, R1). The symbol set 1100 also includes a new Wild symbol 1108 at symbol position C2, R3 selected to appear for the outcome event represented by FIG. 11. Outcome event indicator 704 shows the number of remaining outcome events (e.g., free spins) is 6.

Figure 12:
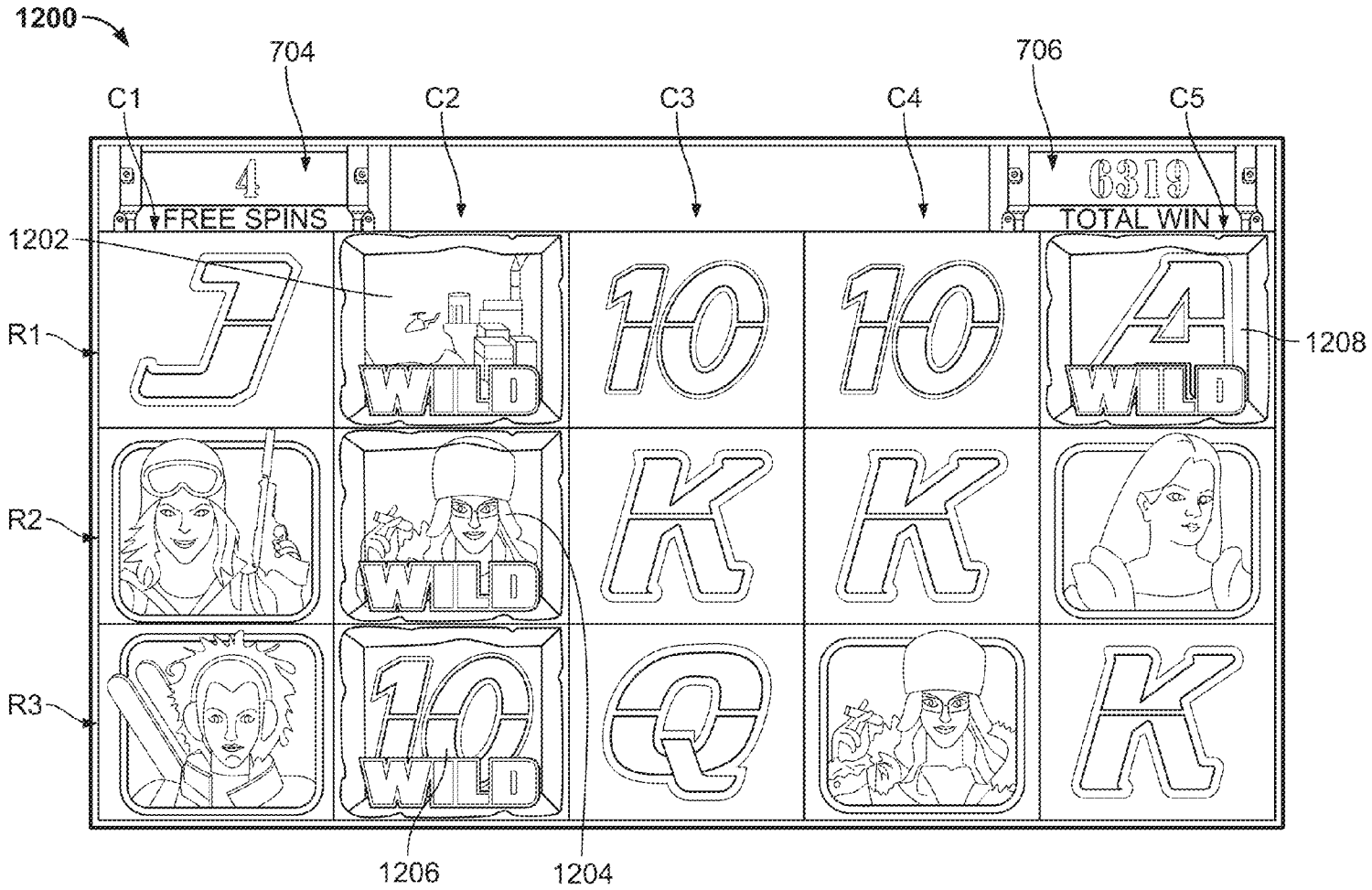
FIG. 12 depicts one more example of a selected symbol set displayed by a display in accordance with the embodiments of the disclosure.

Next, FIG. 12 shows an example of another symbol set 1200 selected from the global symbol group for display during a remaining (e.g., a next) outcome event occurring after the outcome event represented by FIG. 11 and one additional outcome event. The symbol set 1200 can be displayed in a symbol-display-portion 116, 502. The symbol set 1200 includes a Wild symbol 1202 (at symbol position C2, R1) that has been selected during the outcome event represented by FIG. 12, and locked-down symbols 1204, 1206 and 1208 that have been carried over in symbol-display-portion 116 of display 110 from prior outcome events as previously described, at symbol positions C2, R2; C2, R3 and C5, R1, respectively. The Wild symbols 1202, 1204 and 1206 fill column C2 of the symbol-display-portion of display 110. Such a condition, when it arises, may cause the Wild symbols in the column C2 to become locked-down for the remainder of the awarded outcome events that have not yet occurred (i.e. remain to occur). Outcome event indicator 704 shows the number of remaining outcome events (e.g., free spins) is 4.

The outcome events represented by FIG. 7 to FIG. 12 can be bonus outcome events that occur while machine 100 is operating in the second state, but are not so limited.

This description refers to a prior outcome event and a first prior outcome event. As an example, the first prior outcome event can refer to an outcome event represented by FIG. 7. In accordance with that example, the outcome events represented by FIG. 8, FIG. 9, FIG. 10, FIG. 11, and FIG. 12 can be referred to as a second outcome event, a third outcome event, a fourth outcome event, a fifth outcome event and a seventh outcome event, respectively. A sixth outcome event, not represented within the figures for this example, can be an intervening event between the fifth outcome event and the seventh outcome event and when the outcome event indicator 704 indicate five free spins. For this example, the first outcome event through the seventh outcome event indicates an order in which the outcome events occur. For this example and the sixth outcome event, the particular symbol may be displayed at C2, R3; and C5, R1 and symbols other than the particular symbol can be displayed at the other symbol positions of the symbol-display-portion 502. For other examples, the first prior outcome event can refer to an outcome event represented by one of FIG. 8, FIG. 9, FIG. 10, FIG. 11, and FIG. 12 or some other outcome event.

In some embodiments, the awarding of bonus outcome events may be a game feature that is one of multiple game features of a given game. In some instances, machine 100 may make a determination that a trigger condition occurred (e.g., based on a random selection in a base outcome event or base game as described above). And in response to making the determination, machine 100 may randomly select a game feature from a group of game features. Further, in response to selecting the game feature, the machine may perform the appropriate steps to execute the selected game feature. For example, where the game feature is the one described above, in response to selecting the game feature, machine 100 may make the determination as described above at block 304, and then perform one or more of the other functions described herein in connection with FIGS. 3A-3C to execute the game feature. Note that the group of game features may include a variety of different types of game features.

Machine 100 can cause each particular symbol that is locked-down in symbol-display-portion 116 of display 110 to fade out during the successive outcome events of the lock-down period. For example, in each bonus outcome event during the lock-down period of a particular symbol, the machine may display the locked-down symbol by means of an instance of the symbol image of lower intensity than the intensity used to display the symbol in the previous bonus outcome event, as previously described with reference to FIG. 6.

Machine 100 can cause symbol-display segments to spin, and to cause spinning symbol-display segments to stop spinning. The spinning and stopping of the spinning symbol-display segments can be carried out for each outcome event. In accordance with the embodiments in which the symbol-display-portion 116, 502 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

IV. Additional Example Operation

Figure 13A:
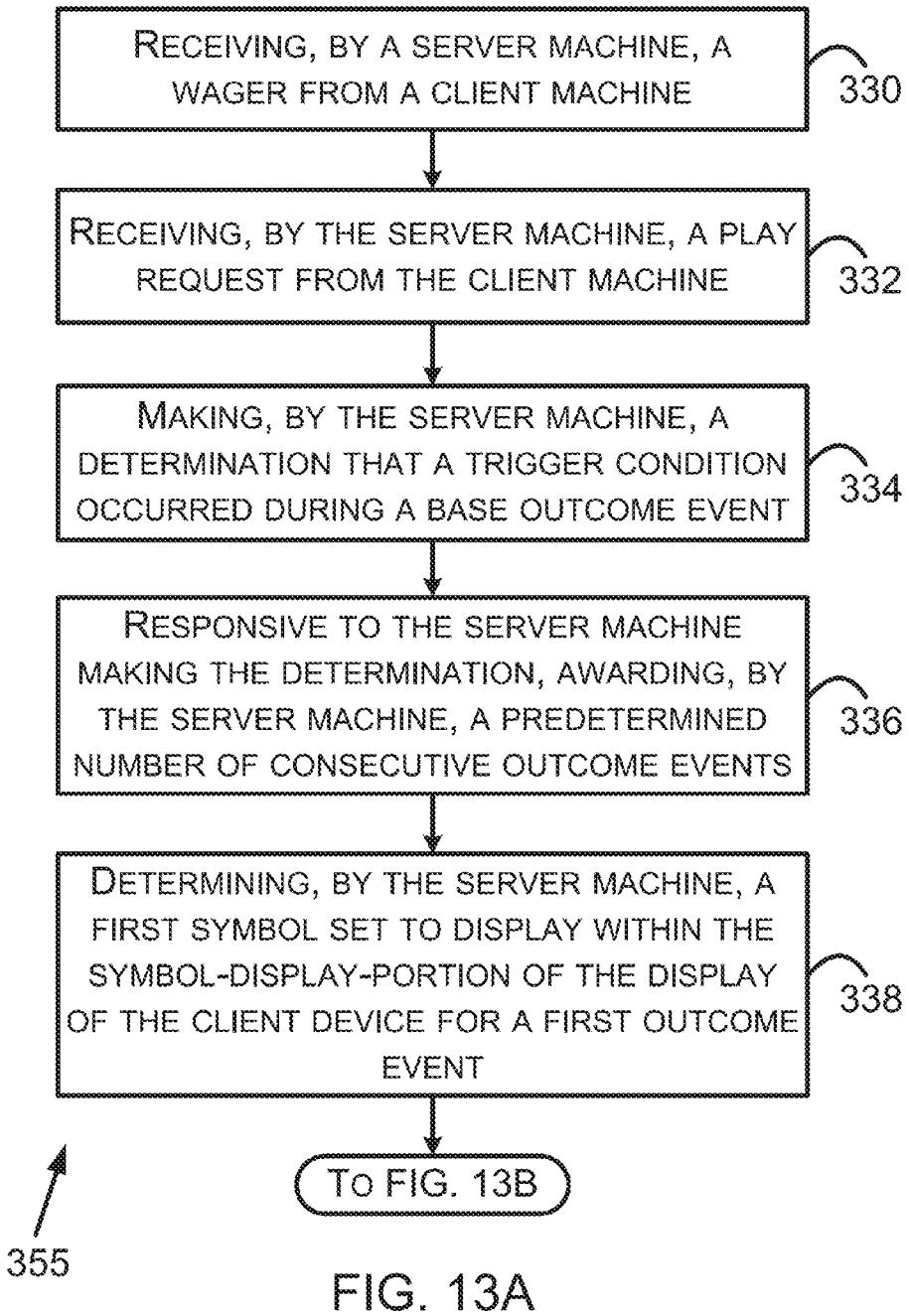
FIG. 13A is a first part of a flow chart showing functions in accordance with a method in an embodiment of the disclosure.
Figure 13B:
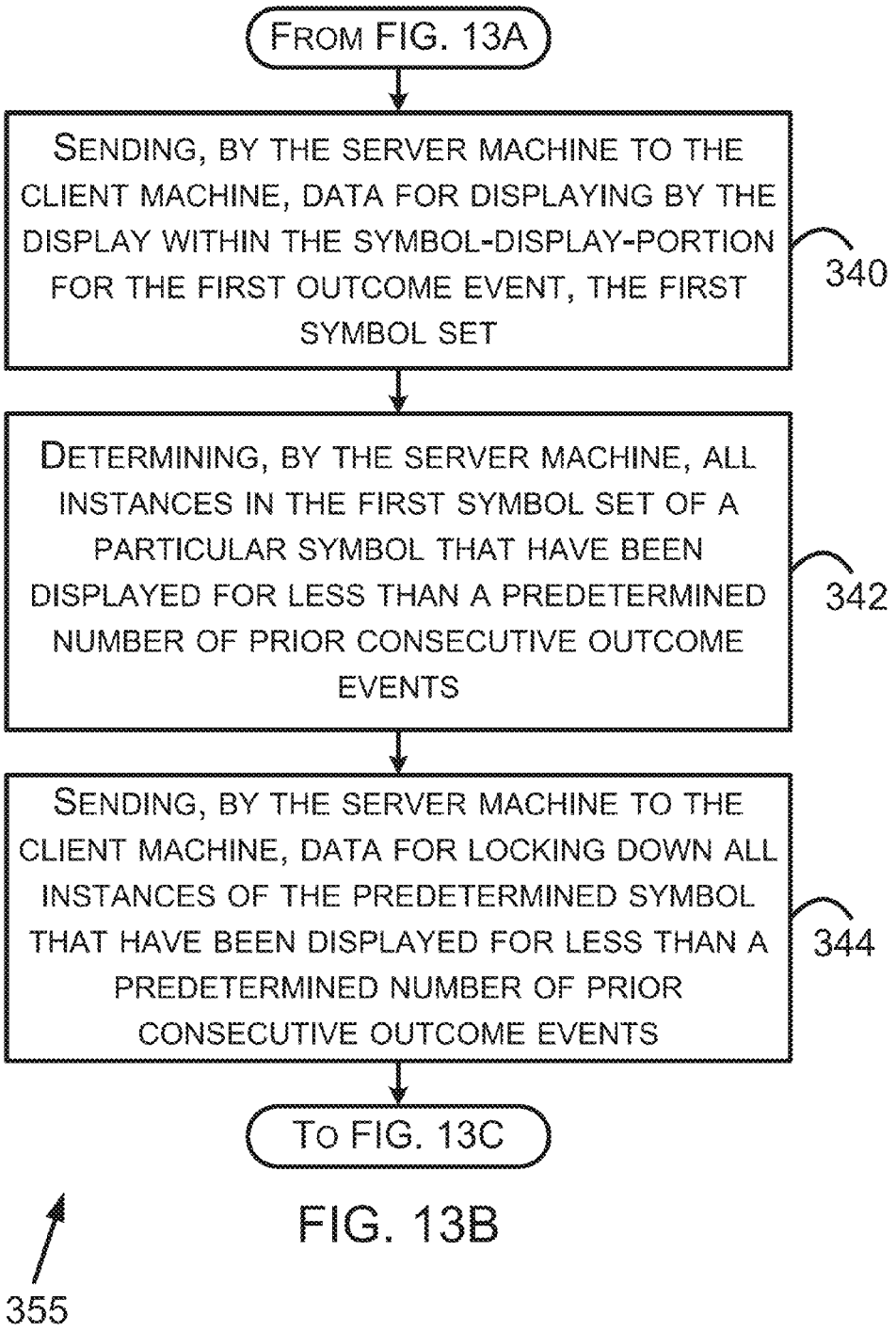
FIG. 13B is a second part of the flow chart of FIG. 13A.
Figure 13C:
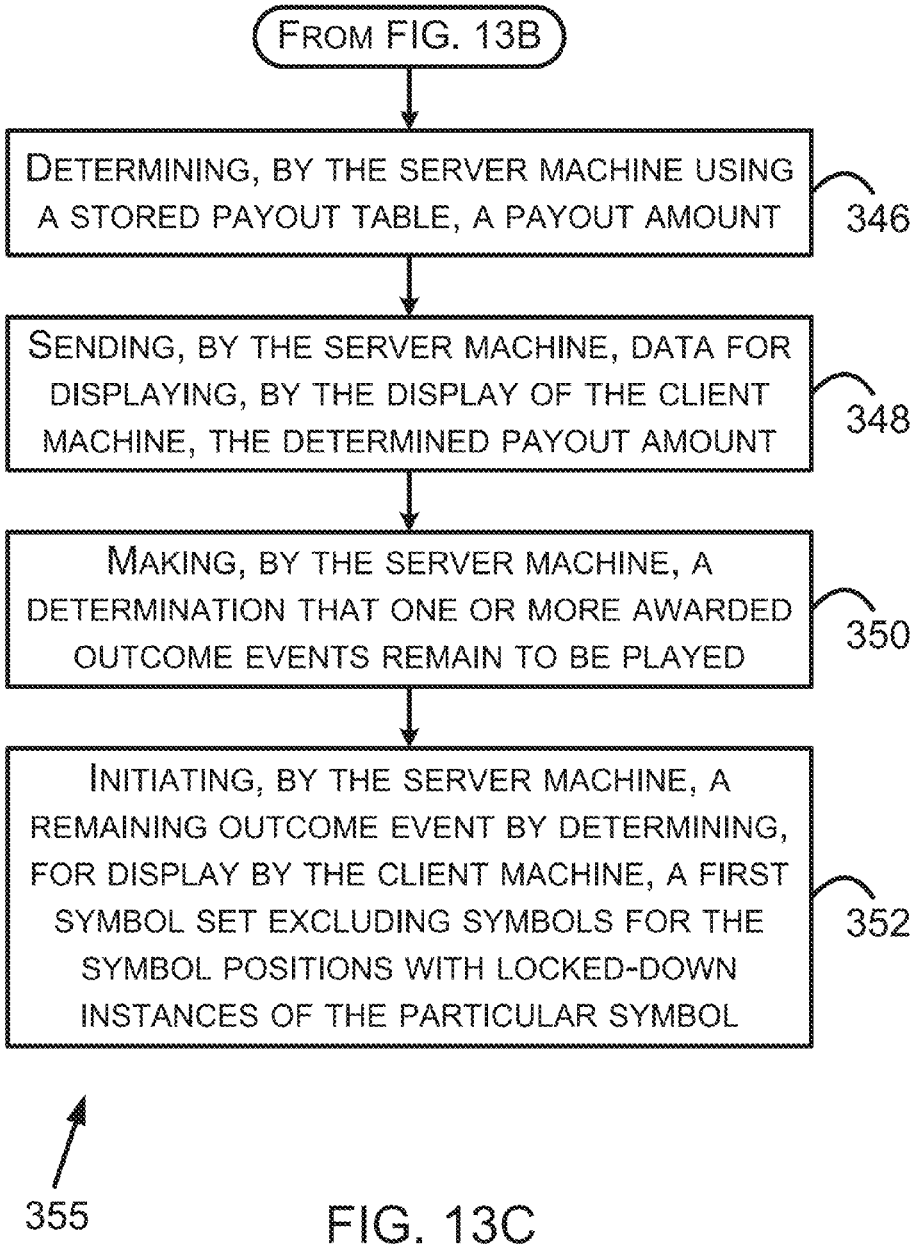
FIG. 13C is a third part of the flow chart of FIG. 13A.

FIG. 13A, FIG. 13B, and FIG. 13C (i.e., FIG. 13A-13C) depict a flowchart showing a set of functions (e.g., operations) 355 (or more simply, "the set 355") that can, for example, be carried out using server machine 100*a*. Note that several of the functions described in connection with FIG. 13A-13C parallel functions described in connection with FIG. 3A-3C. As such, variations of the functions described in connection with FIG. 3A-3C are likewise applicable to the functions described in connection with Figures FIG. 13A-13C. However, for the sake of brevity, these variations are not repeated. Server machine 100*a*, in performing the set 355, can perform the functions described above with respect to machine 100.

Turning to FIG. 13A, block 330 includes receiving, by server machine 100*a* (e.g., by communication interface 102*a*) a wager from client machine 100*b*. Communication interface 102*a* can receive the wager (e.g., a payment) sent from client machine 100*b* over communication network 118. The wager received by server machine 100*a* can be contained within a message configured for transmission over the internet, such as the UDP or TCP. Before server machine 100*a* receives the wager, client machine 100*b* can receive the wager, such as the way in which machine 100 receives the wager as discussed with respect to block 300. In response to server 100*a*, server 100*a* can transmit data to client machine 100*b* for updating wager amount indicator 510.

Next, block 332 includes receiving, by server machine 100*a* (e.g., by communication interface 102*a*), a play request from client machine 100*b*. Communication interface 102*a* can receive the play request sent from client machine 100*b* over communication network 118. Before server machine 100*a* receives the play request, client machine 100*b* can receive the play request, such as the way in which machine 100 receives the wager as discussed with respect to block 302.

Next, block 334 includes making, by server machine 100*a* (e.g., by processor 112*a*), a determination that a trigger condition occurred during a base outcome event. The trigger condition for block 334 can be, but is not limited to be, configured like the trigger condition described with respect to block 304.

Next, block 336 includes, responsive to server machine 100*a* making the determination (i.e., the determination of block 334), awarding, by server machine 100*a* (e.g., by processor 112*a*), a predetermined number of consecutive outcome events. Server machine 100*a* can make the determination of block 336 based on a combination of symbols selected to be displayed by display 110*b* of client machine 100*b* for a base outcome event. The predetermined number determined at block 336 can be as described with respect to block 306. After determining the predetermined number, server machine 100*a* can transmit data indicating the predetermined number to client machine 100*b* for displaying within outcome event counter 505 or 704.

Next, block 338 includes determining, by server machine 100*a* (e.g., by processor 112*a*), a first symbol set to display within the symbol-display-portion of display 110*b* of the client device 100*b* for a first outcome event. Server machine 100*a* can select the first symbol set in a manner similar to how machine 100 selects the first symbol as described with respect to block 308 and FIG. 4.

Turning to FIG. 13B, block 340 includes sending, by server machine 100*a* (e.g., by communication interface 102*a*) to client machine 100*b*, data for displaying by display 110*b* within the symbol-display-portion (SDS) 116*b*, 502 for the first outcome event, the first symbol set. The data sent to client machine 100*b* for displaying the first symbol set can be configured in any of a variety of formats. For example, data sent for block 340 can include a video file to be displayed within SDS 116*b*, 502. As another example, data sent for block 340 can include data contained within a symbol set table, such as first symbol set table 410. A message including the data within first symbol set table 410 can include each record 412 in an sequence, such as shown in FIG. 4. Alternatively, a message including the data within first symbol set table 410 can include the symbol identifiers within records 412 in a sequence that implies the symbol position corresponding to the symbol identifier, such as a sequence of numerical identifiers 1 through 15 shown in FIG. 5.

Next, block 342 includes determining, by server machine 100*a* (e.g., by processor 112*a*), all instances in the first symbol set of a particular symbol that have been displayed for less than a predetermined number of prior consecutive outcome events. The particular symbol can be a Wild symbol (such as Wild symbol 702). Data storage 114*a* can include data structure 1500, which server machine 100*a* can refer to in order to make the determination of block 342. Additionally or alternatively, server machine 100*a* can refer to a symbol set table, such as symbol set table 410, to search for the identifier associated with the particular symbol, such as identifier "1001" associated with the Wild Image in symbol image table 404.

Next, block 344 includes sending, by server machine 100*a* (e.g., by communication interface 102*a*) to client machine 100*b* data for locking down all instances of the particular symbol that have been displayed on display 110*b* of client machine 100*b* for less than a predetermined number of prior consecutive outcome events. Data storage 114*b* can include data structure 1500. Server machine 100*a* can send client machine 100*b* data so that data structure 1500 is modified to include lock-down data, such as the lock-down data shown in column 1200-A. Client machine 100*b* can refer to data structure 1500 or other data within data storage 114*b* to lock down any instances of the particular symbols that server machine 100*a* indicated are to be locked down.

Turning to FIG. 13C, block 346 includes determining, by server machine 100*a* using a stored payout table, a payout amount. Server machine 100*a* or processor 112*a* can determine the payout amount in the manner machine 100 or processor 112 determines the payout as described with respect to block 312.

Next, block 348 includes sending, by server machine 100*a*, data for displaying, by display 110*b* of client machine 100*b*, the determined payout amount. Communication interface 102*a* can send (e.g., transmit) the data including the determined payout amount over communication network 118 alone or along with the data for displaying a set of symbols at display 110*b* or some other data. As an example, the determined payout amount may include a payout amount to display in payout amount indicator 506. As another example, the determined payout amount may include a new value to display in credit balance indicator such that client machine 110*b* or processor 112*b* can determine a difference between the new value and a current value in the credit balance indicator. That difference can be used as the determined payout amount.

Next, block 350 includes making, by server machine 100*a*, a determination that one or more awarded outcome events remain to be played. Data storage 114*a* can include data to indicate a number of remaining outcome events to be played. As an example, server machine 100*a* can make the determination of block 350 by referring to that stored data. Also, communication interface 102*a* can transmit the data indicating the number of remaining outcome events to be played to client machine 100*b* for displaying within outcome event counter 505.

Next, block 352 includes initiating by server machine 100*a* (e.g., by processor 112*a*), a remaining outcome event by determining (such as at block 338) for display by client machine 100*b* (e.g., by display 110*b*), a symbol set excluding symbols corresponding to the symbol positions with locked-down instances of the particular symbol. The initiating function can occur in response to server 100*a* making the determination of block 350. In other words, portions of the set 355 can repeat to carry out distinct outcome events of the predetermined number events.

Figure 14A:
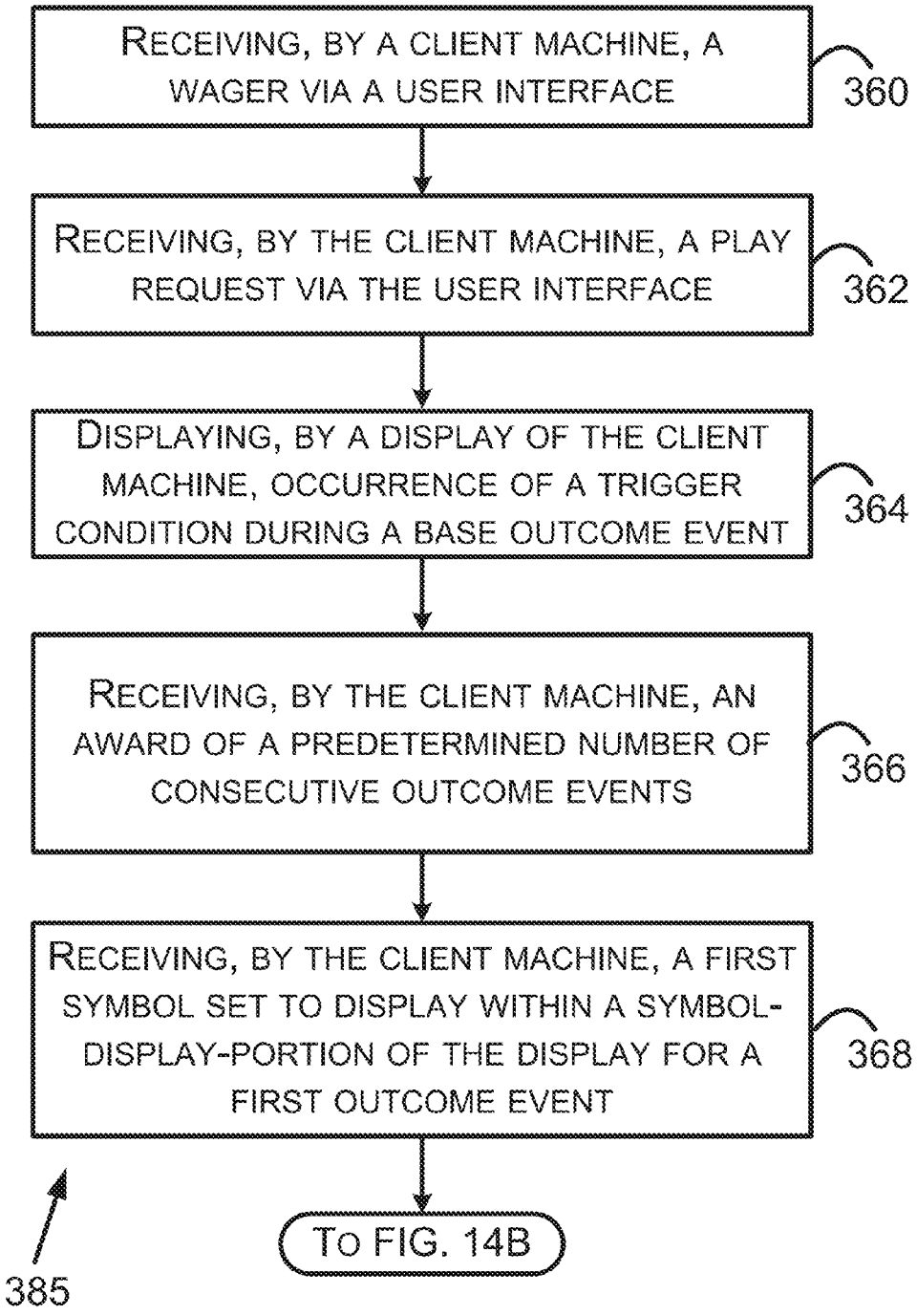
FIG. 14A is a first part of a flow chart showing functions in accordance with a method in an embodiment of the disclosure.
Figure 14B:
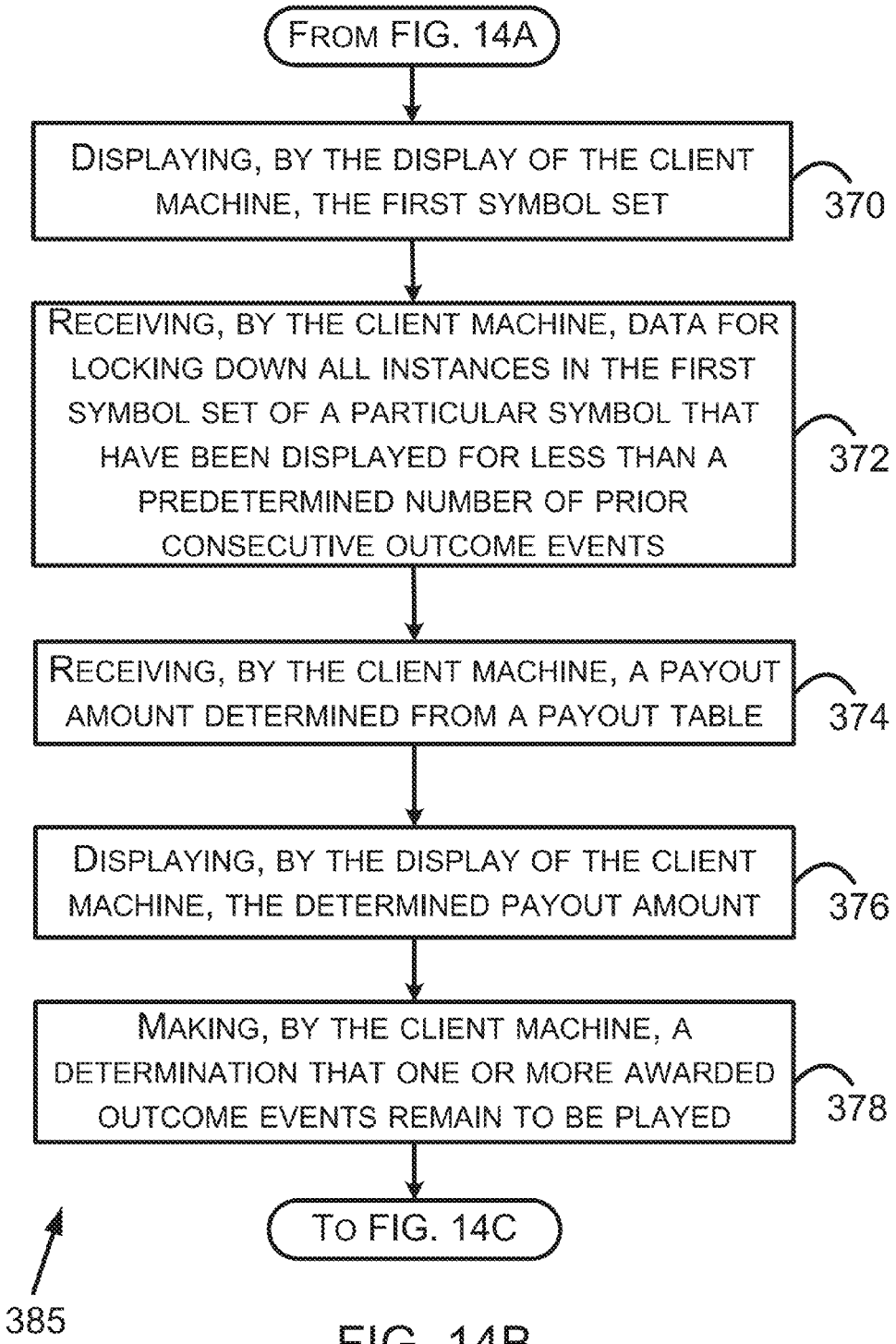
FIG. 14B is a second part of the flow chart of FIG. 14A.
Figure 14C:
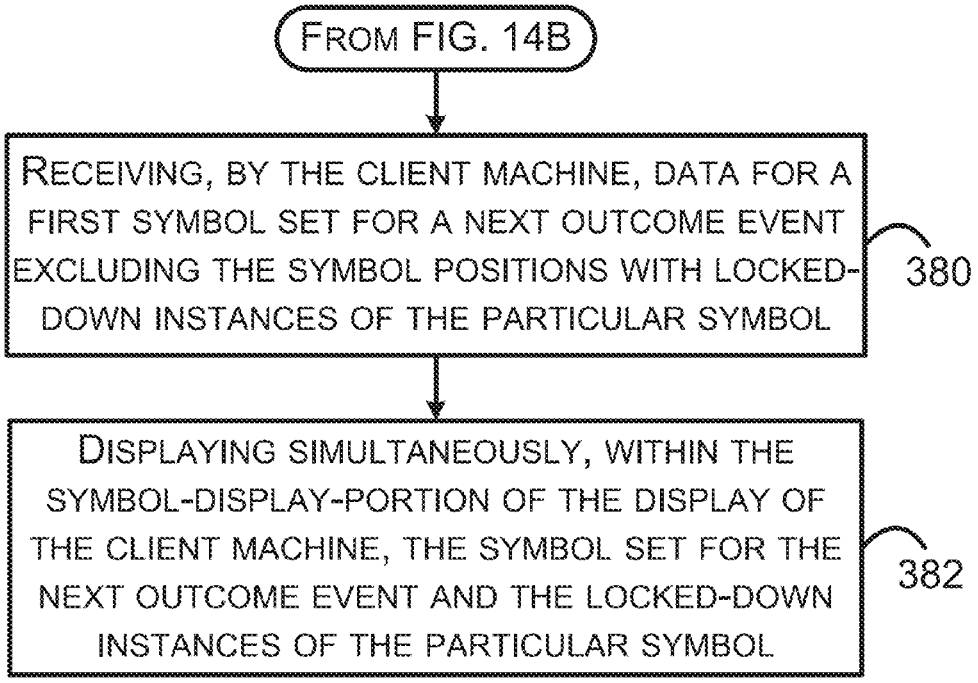
FIG. 14C is a third part of the flow chart of FIG. 14A.

Next, FIG. 14A, FIG. 14B, and FIG. 14C (i.e., FIG. 14A-14C) depict a flowchart showing a set of functions (e.g., operations) 385 (or more simply, "the set 385") that can, for example, be carried out using client machine 100*b*. Note that several of the functions described in connection with FIG. 14A-14C parallel functions described in connection with FIG. 3A-3C and FIG. 13A-13C. As such, variations of the functions described in connection with FIG. 3A-3C and FIG. 13A-13C are likewise applicable to the functions described in connection with Figures FIG. 14A-14C. However, for the sake of brevity, these variations are not repeated. Client machine 100*b*, in performing the set 385, can perform the functions described above with respect to machine 100.

Turning to FIG. 14A, block 360 includes receiving, by client machine 100*b*, a wager via user interface 104*b*. Client machine 100*b* (e.g., by communication interface 102*b*) can transmit the received wager or data indicative thereof over the communication network 118 to server machine 100*a*.

Next, block 362 includes receiving, by client machine 100*b*, a play request via user interface 104*b*. Client machine 100*b* (e.g., by communication interface 102*b*) can transmit the received play request or data indicative thereof over the communication network 118 to server machine 100*a*.

Next, block 364 includes displaying, by display 110*b* of client machine 100*b*, occurrence of a trigger condition during a base outcome event. As an example, the base outcome event can be a reel-type slots game in which one or more instances of a symbol associated with a trigger symbol identifier, such as identifier "1002" in trigger symbol table 416, is displayed or displayed in a particular patter in symbol display portion 116*b*, 502.

Next, block 366 includes receiving, by client machine 100*b* (e.g., by communication interface 102*b*), an award of a predetermined number of consecutive outcome events. Server machine 100*a* may transmit the award in response to performance of block 334. As an example, the outcome events can be free spins of the reels or matrix displayable in symbol-display-portion 116*b*, 502. Client machine 100*b* can update outcome event identifier 504 to indicate the received award. Client machine 100*b* can update outcome event counter 505 to indicate the predetermined number of consecutive events awarded.

Next, block 368 includes receiving, by client machine 100*b* (e.g., by communication interface 102*b*), a first symbol set to display within a symbol-display-portion 116*b*, 502 of display 110*b* for a first outcome event. Client machine 100*b* can receive the first symbol set in response to performance of block 340. The example messages and data discussed with respect to 340 can be received by client machine 100*b* in order to receive the first symbol set and other symbol sets for other outcome events. Other example messages and data including or indicating the first symbol set can be received by client machine 100*b* in order to receive the first symbol set.

Turning to FIG. 14B, block 370 includes displaying, by display 110*b* within the symbol-display-portion 116*b*, 502 of client machine 100*b* for the first outcome event, the first symbol set. Displaying the first symbol set at block 370 can occur in response to performance of block 340. Displaying the first symbol set can result in displaying a set of symbols as shown in any of FIG. 7 to FIG. 12, but is not so limited.

Next, block 372 includes receiving, by client machine 100*b* (e.g., by communication interface 102*b*), data for locking down all instances in the first symbol set of a particular symbol that have been displayed for less than a predetermined number of prior consecutive outcome events. Data storage 114*b* can include data structure 1500 and the data received at block 372 can be stored within data structure 1500 as in column 1200-A to show that the particular symbols displayed at symbol position C2, R1, symbol position C2, R2, and symbol position C2, R3 are instances of the particular symbol being locked down.

Next, block 374 includes receiving, by client machine 100*b* (e.g., by communication interface 102*b*), a payout amount determined from a payout table. Receiving the payout amount can occur in response to performance of block 348.

Next, block 376 includes displaying, by display 110*b* of client machine 100*b*, the determined payout amount. The payout amount can be displayed by payout amount indicator 506.

Next, block 378 includes making, by client machine 100*b* (e.g., by processor 112*b*), a determination that one or more awarded bonus outcome events remain to be played. Client machine 100*b* can receive data indicating the number of remaining outcome events to be played from server machine 100*a* for displaying within outcome event counter 505.

Turning to FIG. 14C, block 380 includes receiving, by client machine 100*b* (e.g., by communication interface 102*b*), data for a symbol set to display within the symbol-display-portion of display 110*b*, 502 for a next outcome event, excluding the symbol positions with locked-down instances of the particular symbol. Receiving the symbol set at block 380 can be carried out as described above with respect to how the first symbol set is received at block 368.

Next, block 382 includes displaying, simultaneously by display 110*b* of client machine 100*b*, the symbol set for the next outcome event and the locked-down instances of the particular symbol. Referring to FIG. 7 and FIG. 8, the instances of the particular symbol 702 displayed for the outcome event represented by FIG. 7 are locked down for the outcome event represented by FIG. 8 (e.g., the next outcome event) and are identified as particular symbols 802. The displayed symbols in the symbol-display-portion shown in FIG. 8, other than symbols 802, can be the symbols of the symbol set selected for the next outcome event.

V. Conclusions

While one or more disclosed functions have been described as being performed by certain entities (e.g., machine 100, server machine 100*a*, or client machine 100*b*), one or more of the functions may be performed by any entity, including but not limited to those described herein. As such, while this disclosure includes examples in which server machine 100*a* performs select functions and sends data to client machine 100*b*, such that client machine 100*b* may perform complementing functions and receive the data, variations to those functions may be made while adhering to the general server-client dichotomy and the scope of the disclosed machines and methods.

For example, rather than server machine 100*a* sending select data (e.g., a symbol set) to client machine 100*b*, such that the client machine may generate and display appropriate images, server machine 100*a* may itself generate the images and send them to client machine 100*b* for display. Indeed, it will be appreciated by one of ordinary skill in the art that the "break point" between the server machine's functions and the client machine's functions may be varied with ease.

Further, the described functions throughout this application need not be performed in the disclosed order, although in some examples, the recited order may be preferred. Also, not all functions need to be performed to achieve the desired advantages of disclosed machines and methods, and therefore not all functions are required While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

The invention claimed is:

1. A method comprising:

determining, by a processor of a machine:

a first current outcome event, a first set of symbols and a corresponding symbol position for each symbol of the first set of symbols;

receiving a play request using an input component of a user interface of the machine, wherein the user interface further comprises a display;

determining, by the processor, for the first current outcome event, that a first instance of a particular symbol determined by the processor to be displayed at a first corresponding symbol position within a symbol-display portion of the display for a first prior outcome event has been displayed less than a predetermined number of consecutive outcome events at the first corresponding symbol position following the first prior outcome event;

after receiving the play request, displaying, on the display, an animation associated with the first set of symbols; and displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

2. The method of claim 1, further comprising:

determining, by the processor for the first current outcome event, a payout amount associated with displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols; and providing for, by the processor for the first current outcome event, distribution of the payout amount to an account of an individual or to the individual.

3. The method of claim 1, further comprising:

determining, by the processor, that displaying the first set of symbols includes displaying a second instance of the particular symbol at a second corresponding symbol position within the symbol-display-portion of the display along with at least one other instance of the particular symbol at a corresponding symbol position within the symbol-display-portion of the display to form a specific pattern of multiple instances of the particular symbol; and displaying, within the symbol-display-portion of the display for each outcome event following the first outcome event until a last awarded outcome event of a predetermined number of awarded outcome events is completed, the multiple instances of the particular symbols at the corresponding symbol positions within the symbol-display portion of the display that form the specific pattern.

4. The method of claim 3, wherein the symbol-display-portion of the display includes a matrix including multiple columns of symbol positions and multiple rows of symbol positions, and wherein the specific pattern of multiple instances of the particular symbol includes a pattern in which each symbol position of a column of symbol positions displays an instance of the particular symbol.

5. The method of claim 3, wherein the symbol-display-portion of the display includes a matrix including multiple columns of symbol positions and multiple rows of symbol positions, and wherein the specific pattern of multiple instances of the particular symbol includes a pattern in which each symbol position of a row of symbol positions displays an instance of the particular symbol.

6. The method of claim 3, wherein a quantity of the each outcome event following the first outcome event is greater than the predetermined number of consecutive outcome events.

7. The method of claim 3, further comprising:

determining, by the processor while operating in a first state in which base outcome events are carried out, occurrence of a trigger condition during a base outcome event that triggers the processor to switch to operating in a second state in which the predetermined number of awarded outcome events are carried out; and in response to determining occurrence of the trigger condition, switching, by the processor, from operating in the first state to operating in the second state.

8. The method of claim 1, wherein the symbol-display-portion of the display includes a particular number of symbol positions for displaying symbols.

9. The method of claim 8, wherein the first set of symbols includes a number of symbols equal to the particular number of symbol positions.

10. The method of claim 9, wherein displaying the first instance of the particular symbol determined by the processor for the first prior outcome event at the first corresponding symbol position and the first set of symbols at the corresponding symbol position for each symbol of the first set of symbols includes displaying a symbol of the first set of symbols overlaid with the first instance of the particular symbol at the first corresponding symbol position within the symbol-display-portion of the display.

11. The method of claim 9, further comprising:

determining, by the processor, a first determination that the first set of symbols includes an instance of the particular symbol to be displayed at a given corresponding symbol position at which another instance of the particular symbol was, during a prior outcome event occurring prior to the first outcome event without any intervening prior outcome event, determined for displaying during the first outcome event at the given corresponding symbol position; and in response to the first determination, displaying, within the symbol-display-portion of the display for each outcome event following the first outcome event until a last awarded outcome event of the predetermined number of awarded outcome events is completed, the instance of the particular symbol to be displayed at the given corresponding symbol position within the symbol-display portion of the display.

12. The method of claim 8, wherein the first set of symbols includes a number of symbols equal to the particular number of symbol positions less a number of instances of the particular symbol that were displayed in a given prior outcome event occurring prior to the first outcome event without any intervening prior outcome event, but not less any instance of the particular symbol that was displayed in the given prior outcome event occurring prior to the first outcome event and is not to be displayed for the first outcome event.

13. The method of claim 1, wherein, the first set of symbols includes a third instance of the particular symbol, wherein the third instance of the particular symbol is displayed at a third corresponding symbol position for the first outcome event, the method further comprising:

displaying the third instance of the particular symbol at the third corresponding symbol position for the predetermined number of consecutive outcome events immediately following the first outcome event.

14. The method of claim 1, further comprising:

storing, by a computer-readable medium, a data structure including data that indicates whether each symbol position within the symbol-display-portion of the display is to include an instance of the particular symbol for an outcome event occurring after an outcome event in which the instance of the particular symbol was determined for display; and storing within the data structure a count for each symbol position to include an instance of the particular symbol for an outcome event occurring after an outcome event in which the instance of the particular symbol was determined for display, wherein the count indicates how many more times the instance of the particular symbol is to be displayed or how many times the instance of the particular symbol has been displayed since the instance of the particular symbol was determined for display.

15. The method of claim 1, wherein the first outcome event is one of a predetermined number of bonus outcome events awarded based on occurrence of a trigger condition during a base outcome event prior to the first outcome event.

16. A machine comprising:

a processor;

a user interface, comprising an input component and a display; and a non-transitory computer-readable medium storing computer-readable program instructions, that when executed by the processor, cause a set of functions to be performed, the set of functions comprising:

determining, by the processor:

a first current outcome event, a first set of symbols and a corresponding symbol position for each symbol of the first set of symbols;

receiving a play request using the input component;

determining, by the processor for the first current outcome event, that a first instance of a particular symbol determined by the processor to be displayed at a first corresponding symbol position within a symbol-display portion of the display for a first prior outcome event has been displayed less than a predetermined number of consecutive outcome events at the first corresponding symbol position following the first prior outcome event;

after receiving the play request, displaying, on the display, an animation associated with the first set of symbols; and displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

17. A method comprising:

determining, by a processor of a server machine:

a first current outcome event, a first set of symbols and a corresponding symbol position for each symbol of the first set of symbols;

receiving, at the server machine, a play request from a client machine via a communications network;

determining, by the processor for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event;

after receiving the play request, transmitting data related to an animation associated with the first set of symbols from the server machine to the client machine over the communications network; and transmitting, over a communication network from the server machine to the client machine, data for displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

18. A server machine comprising:

a processor;

a communication interface; and a non-transitory computer-readable medium storing software instructions, that when executed by the processor, perform a set of functions, wherein the set of functions comprises:

determining, by the processor:

a first current outcome event, a first set of symbols and a corresponding symbol position for each symbol of the first set of symbols;

determining, for the first current outcome event, that a first instance of a particular symbol determined by the processor to be displayed at a first corresponding symbol position within a symbol-display portion of a display for a first prior outcome event has been displayed less than a predetermined number of consecutive outcome events at the first corresponding symbol position following the first prior outcome event;

transmitting data related to an animation associated with the first set of symbols from the server machine to a client machine over a communications network; and transmitting, over the communication network from the server machine to the client machine, data for displaying, within the symbol-display-portion of the display for the first current outcome event, the first instance of the particular symbol, determined by the processor to be displayed at the first corresponding symbol position for the first prior outcome event, at the first corresponding symbol position, and the first set of symbols at the corresponding symbol position for each symbol of the first set of symbols.

19. A method comprising:

sending, from a client machine to a server machine using a communications network, a play request;

receiving, by the client machine from the server machine using the communications network, a first current outcome event, data indicating a first set of symbols and a corresponding symbol position for each symbol of the first set of symbols;

receiving, by the client machine from the server machine using the communications network, data related to an animation associated with the first set of symbols;

displaying, on a display of the client machine, the animation associated with the first set of symbols;

receiving, by the client machine from the server machine for the first current outcome event using the communications network, data indicating that a first instance of a particular symbol determined for displaying at a first corresponding symbol position within a symbol-display portion of a display for a first prior outcome event has been displayed less than a predetermined number of consecutive outcome events at the first corresponding symbol position following the first prior outcome event; and displaying, using the display of the client machine by a display within the symbol-display-portion of the display for the first current outcome event, the first instance of the particular symbol, received by the client machine to be displayed at the first corresponding symbol position for the first prior outcome event, at the first corresponding symbol position, and the first set of symbols at the corresponding symbol position for each symbol of the first set of symbols, wherein the display is part of the client machine.

20. A client machine comprising:

a processor;

a user interface, comprising an input component and a display;

a communication interface; and a non-transitory computer-readable medium storing software instructions, that when executed by the processor, perform a set of functions, wherein the set of functions comprises:

receiving, using the communications interface, a first current outcome event, data indicating a first set of symbols and a corresponding symbol position for each symbol of the first set of symbols;

receiving, using the input component of the user interface, a play request;

receiving, using the communications interface, for the first current outcome event, data indicating that a first instance of a particular symbol determined for displaying at a first corresponding symbol position within a symbol-display portion of the display for a first prior outcome event has been displayed less than a predetermined number of consecutive outcome events at the first corresponding symbol position following the first prior outcome event;

after receiving the play request, displaying, using the display, an animation associated with the first set of symbols; and displaying, by a display within the symbol-display-portion of the display for the first current outcome event, the first instance of the particular symbol, received by the client machine to be displayed at the first corresponding symbol position for the first prior outcome event, at the first corresponding symbol position, and the first set of symbols at the corresponding symbol position for each symbol of the first set of symbols.

* * * * *